US008028838B2

(12) United States Patent
McDonald et al.

(10) Patent No.: US 8,028,838 B2
(45) Date of Patent: Oct. 4, 2011

(54) SUSPENSION PACKAGE ASSEMBLY

(75) Inventors: John McDonald, Fallbrook, CA (US); Frank Comerford, Laguna Niguel, CA (US); Myles Comerford, Rancho Santa Fe, CA (US)

(73) Assignee: Clearpak, LLC, Tustin, CA (US)

( * ) Notice: Subject to any disclaimer, the term of this patent is extended or adjusted under 35 U.S.C. 154(b) by 0 days.

(21) Appl. No.: 12/834,825

(22) Filed: Jul. 12, 2010

(65) Prior Publication Data

US 2010/0276332 A1 Nov. 4, 2010

Related U.S. Application Data

(62) Division of application No. 11/687,443, filed on Mar. 16, 2007, now abandoned.

(51) Int. Cl.
*B65D 81/07* (2006.01)

(52) U.S. Cl. ..... 206/583; 206/521; 206/591

(58) Field of Classification Search ..... 206/466, 206/521, 583, 591, 594, 497, 592, 593; 383/66, 383/120
See application file for complete search history.

(56) References Cited

U.S. PATENT DOCUMENTS

| | | | | |
|---|---|---|---|---|
| 1,821,692 | A | 9/1931 | Copeland | |
| 2,161,128 | A | 6/1939 | Boyle | |
| 2,746,665 | A | 4/1950 | Wiggins | |
| 2,948,455 | A | 8/1960 | Frankenstein | |
| 2,956,672 | A * | 10/1960 | Kirkpatrick | 206/497 |
| 3,047,137 | A | 7/1962 | Kindseth | |
| 3,326,410 | A | 6/1967 | Asenbauer | |
| 3,345,643 | A | 10/1967 | Bradley | |
| 3,853,220 | A | 12/1974 | Luray | |
| 3,905,474 | A | 9/1975 | Haibara | |
| 3,917,108 | A | 11/1975 | Thurman | |
| 4,077,518 | A | 3/1978 | Kisslinger et al. | |
| 4,155,453 | A | 5/1979 | Ono | |
| 4,335,817 | A * | 6/1982 | Bahr | 383/204 |
| 4,606,460 | A | 8/1986 | Luray | |
| 4,852,743 | A | 8/1989 | Ridgeway | |
| 4,923,065 | A | 5/1990 | Ridgeway | |
| 5,024,536 | A | 6/1991 | Hill | |

(Continued)

FOREIGN PATENT DOCUMENTS

DE 299 21 203 U1 2/2000

(Continued)

OTHER PUBLICATIONS

International Search Report dated Jul. 22, 2008 from PCT/US2008/57132, filed on Mar. 14, 2008 (2 pages), Jul. 22, 2008.

(Continued)

*Primary Examiner* — David Fidei
(74) *Attorney, Agent, or Firm* — Knobbe Martens Olson & Bear LLP

(57) ABSTRACT

A suspension package assembly can include a package member, a stretchable retention member, and a closure device disposed on the stretchable retention member. The package member and a stretchable retention member cooperate to suspend at least one article. At least one article can be held securely between the retention member and a base member of the foldable member. The pocket of the retention member can be positioned over the foldable portions of the package member. The foldable portions can fit into the pockets and then can be folded so as to generate tension in the retention member.

15 Claims, 24 Drawing Sheets

U.S. PATENT DOCUMENTS 5,046,659 A 9/1991 Warburton
5,056,665 A 10/1991 Boecker et al.
5,071,009 A 12/1991 Ridgeway
5,076,436 A 12/1991 Bortolani et al.
5,080,497 A 1/1992 Peppiatt
5,183,159 A 2/1993 Hojnacki et al.
5,211,290 A 5/1993 Janus et al.
5,218,510 A 6/1993 Bradford
5,223,121 A 6/1993 Dickie et al.
5,226,542 A 7/1993 Boecker et al.
5,226,734 A * 7/1993 Scott et al. ..... 383/22
5,251,760 A 10/1993 Smith et al.
5,323,896 A 6/1994 Jones
5,372,257 A 12/1994 Beauchamp et al.
5,388,701 A 2/1995 Ridgeway
5,394,985 A 3/1995 Van Hest
5,405,000 A 4/1995 Hagedon et al.
5,492,223 A 2/1996 Boardman et al.
5,579,917 A 12/1996 Lofgren et al.
5,641,068 A 6/1997 Warner
5,669,506 A 9/1997 Lofgren et al.
5,676,245 A 10/1997 Jones
5,678,695 A 10/1997 Ridgeway
5,694,744 A 12/1997 Jones
5,722,541 A 3/1998 Lofgren et al.
5,738,218 A 4/1998 Gonzales
5,769,235 A 6/1998 Keach et al.
5,788,081 A 8/1998 Bates et al.
5,797,493 A 8/1998 Watson
5,803,267 A 9/1998 Tu et al.
5,823,348 A 10/1998 Phillips et al.
5,823,352 A 10/1998 Mena et al.
5,893,462 A 4/1999 Ridgeway
5,894,932 A 4/1999 Harding et al.
5,954,203 A 9/1999 Marconi
5,967,327 A 10/1999 Jones
RE36,412 E 11/1999 Jones
5,975,307 A 11/1999 Harding et al.
5,988,387 A 11/1999 Staal et al.
6,006,917 A 12/1999 Loeffler
6,010,003 A 1/2000 Wilkinson
6,073,761 A 6/2000 Jones
6,079,563 A 6/2000 Katchmazenski
6,119,863 A 9/2000 Lofgren et al.
6,148,591 A 11/2000 Ridgeway et al.
6,158,589 A 12/2000 Smith et al.
6,206,194 B1 3/2001 Beneroff et al.
6,223,901 B1 5/2001 Lofgren et al.
6,289,655 B1 9/2001 Ridgeway et al.
6,311,843 B1 11/2001 Smith et al.
6,311,844 B1 11/2001 Ridgeway et al.
6,398,412 B2 6/2002 Wedi et al.
6,467,624 B1 10/2002 Lofgren et al.
6,675,973 B1 1/2004 McDonald et al.
6,899,229 B2 5/2005 Dennison et al.
6,920,981 B2 7/2005 Lofgren et al.
6,942,101 B2 9/2005 Lofgren et al.
7,000,774 B2 2/2006 Bryant
7,086,534 B2 8/2006 Roesel et al.
7,150,356 B2 12/2006 Lofgren et al.
7,290,662 B2 11/2007 Lofgren et al.
7,296,681 B2 11/2007 McDonald et al.
7,299,926 B2 11/2007 Russel et al.
7,731,032 B2 6/2010 McDonald et al.
7,743,924 B2 6/2010 McDonald et al.
7,753,209 B2 7/2010 McDonald et al.
7,775,367 B2 8/2010 McDonald et al.
2001/0047950 A1 12/2001 Beneroff et al.
2003/0034273 A1 2/2003 Auclair
2003/0209463 A1 11/2003 Halpin
2003/0234207 A1 12/2003 Koike
2004/0108239 A1* 6/2004 McDonald et al. ..... 206/521
2004/0178113 A1 9/2004 Lofgren et al.
2005/0011807 A1 1/2005 Dennison et al.
2005/0121354 A1 6/2005 Gillis et al.
2006/0000743 A1 1/2006 Lofgren et al.
2006/0042995 A1 3/2006 McGrath et al.
2006/0102515 A1 5/2006 McDonald et al.
2006/0138018 A1 6/2006 McDonald et al.
2006/0213803 A1 9/2006 Saitou et al.
2007/0251854 A1* 11/2007 McDonald et al. ..... 206/583
2008/0067103 A1 3/2008 McDonald et al.
2008/0099368 A1 5/2008 McDonald et al.
2008/0110788 A1 5/2008 Keiger
2008/0110794 A1 5/2008 Anderson et al.
2008/0128316 A1 6/2008 McDonald et al.
2008/0223750 A1 9/2008 McDonald et al.
2009/0272667 A1* 11/2009 McDonald et al. ..... 206/583
2010/0140333 A1 6/2010 McDonald et al.
2010/0276330 A1* 11/2010 McDonald et al. ..... 206/583

FOREIGN PATENT DOCUMENTS

DE 101 05 487 A1 8/2002
EP 1 561 693 A1 8/2005
SU 827346 A1 5/1981
WO WO 00/53499 A2 9/2000

OTHER PUBLICATIONS

Written Opinion of International Searching Authority dated Jul. 22, 2008 from PCT/US2008/57132, filed on Mar. 14, 2008 (5 pages), Jul. 22, 2008.

* cited by examiner

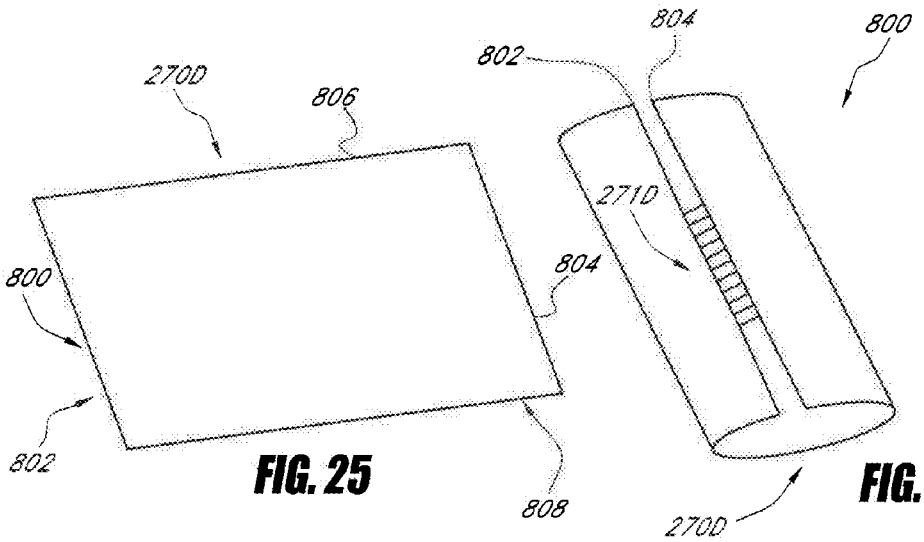
FIG. 25
FIG. 26
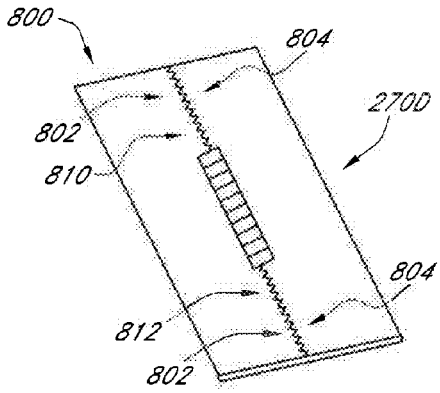
FIG. 27
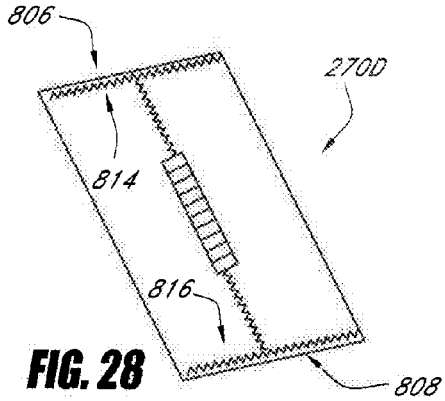
FIG. 28
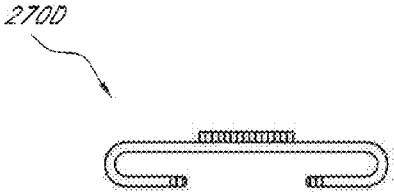
FIG. 29
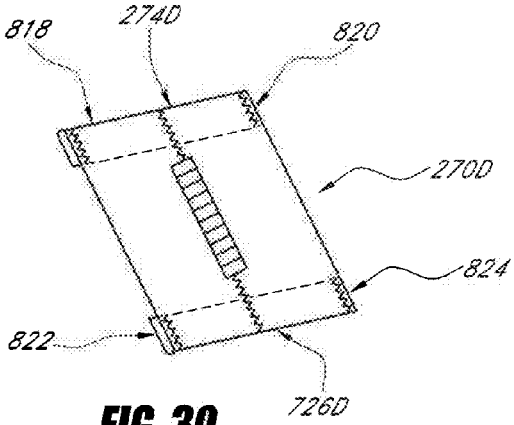
FIG. 30

SUSPENSION PACKAGE ASSEMBLY

PRIORITY INFORMATION

This application is a divisional application of U.S. patent application Ser. No. 11/687,443, titled SUSPENSION PACKAGE ASSEMBLY, filed Mar. 16, 2007, the entire contents of which is hereby expressly incorporated by reference.

BACKGROUND OF THE INVENTIONS

1. Field of the Inventions

The present inventions are directed to a package assembly. In particular, the present inventions are directed to a suspension package assembly that includes a stretchable retention member and a packaging member.

2. Description of the Related Art

Protective packaging devices are often used to protect goods from shocks and impacts during shipping or transportation. For example, when transporting articles that are relatively fragile, it is often desirable to cushion the article inside a box to protect the article from a physical impact with the inner walls of the box that might be caused by shocks imparted to the box during loading, transit, and/or unloading.

In most cases, some additional structure is used to keep the article from moving uncontrollably within the box. Such additional structures include paper or plastic packing material, structured plastic foams, foam-filled cushions, and the like. Ideally, the article to be packaged is suspended within the box so as to be spaced from at least some of the walls of the box, thus protecting the article from other foreign objects which may impact or compromise the outer walls of the box.

U.S. Pat. No. 6,675,973 discloses a number of inventions directed to suspension packaging assemblies which incorporate frame members and one or more retention members. For example, many of the embodiments of the U.S. Pat. No. 6,675,973 include the use of a retention member formed of a resilient material. Additionally, some of the retention members include pockets at opposite ends thereof.

In several of the embodiments disclosed in the U.S. Pat. No. 6,675,973, free ends of the frame members are inserted into the pockets of the retention member. The free ends of the frame member are then bent, pivoted, or folded to generate the desired tension in the retention member. Because the retention member is made from a resilient material, the retention member can stretch and thus provide a mechanism for suspending an article to be packaged, for example, within a box.

SUMMARY OF THE INVENTIONS

An aspect of at least one of the embodiments disclosed herein includes the realization that packaging devices that are designed to retain items to be packaged using a thin stretchable film can be further improved by providing a closure device in the stretchable sheet material. As such, the packaging device can be transported to the customer in a more ready-to-use state. For example, such a packaging device can be delivered to the customer, such that the customer can simply open the closure device, insert the item to be packaged, then close the closure device. As such, the customer is not required to perform some steps that might otherwise have been required to place the article within the device.

Thus, in accordance with an embodiment, a packaging kit for packaging an article and maintaining the article in a position spaced from a wall of a container, can comprise a resilient member comprising a body portion and first and second pockets disposed at opposite ends of the body portion, and at least one closure device configured to be openable and closeable. Additionally, a substantially rigid member can comprise a base member sized to support the article, and a first foldable portion and a second foldable portion configured to be pivotable relative to the base member, at least a portion of the first foldable portion configured to fit with the first pocket and at least a portion of the second foldable portion configured to fit within the second pocket.

In accordance with another embodiment, a package assembly comprise a first resilient portion, a substantially rigid member configured to engage the first resilient portion, and means for providing an opening through the first resilient portion.

All of these embodiments are intended to be within the scope of at least one of the inventions disclosed herein. These and other embodiments of the inventions will become readily apparent to those skilled in the art from the following detailed description of the preferred embodiments having reference to the attached figures, the inventions not being limited to any particular preferred embodiment disclosed.

BRIEF DESCRIPTION OF THE DRAWINGS

These and other features of the inventions are described below with reference to the drawings of several embodiments of the present package assemblies and kits which are intended to illustrate, but not to limit, the inventions. The drawings contain the following figures:

FIG. 25 is a perspective view of a resilient sheet member used to form another modification of the retention member illustrated in FIG. 2;

FIG. 26 is a perspective illustration of the resilient sheet of FIG. 25 having been folded into a tubular shape and having a closure device installed thereon;

FIG. 27 is another perspective view of the retention member illustrated in FIGS. 25 and 26 having been heat sealed along some edges thereof;

FIG. 28 is another perspective view of the retention member illustrated in FIG. 27 having additional edges heat sealed;

FIG. 29 is a side elevational view of the retention member illustrated in FIG. 28 having its longitudinal ends folded;

FIG. 30 is a perspective view of the retention member illustrated in FIG. 29 with additional edges having been heat sealed;

DETAILED DESCRIPTION OF EMBODIMENTS

An improved package assembly is disclosed herein. The package assembly includes an improved structure which provides new alternatives to known suspension packaging systems.

In the following detailed description, terms of orientation such as "upper," "lower," "longitudinal," "horizontal," "vertical," "lateral," "midpoint," and "end" are used herein to simply the description in the context of the illustrated embodiments. Because other orientations are possible, however, the present inventions should not be limited to the illustrated orientations. Additionally, the term "suspension" is not intended to require that anything, such as an article to be packaged, is suspended above anything. Rather, the terms "suspended" as used herein, is only intended to reflect that such an article is held in a position spaced from another member, such as at least one of the walls of a container or box. Those skilled in the art will appreciate that other orientations of various components described herein are possible.

Figure 1:
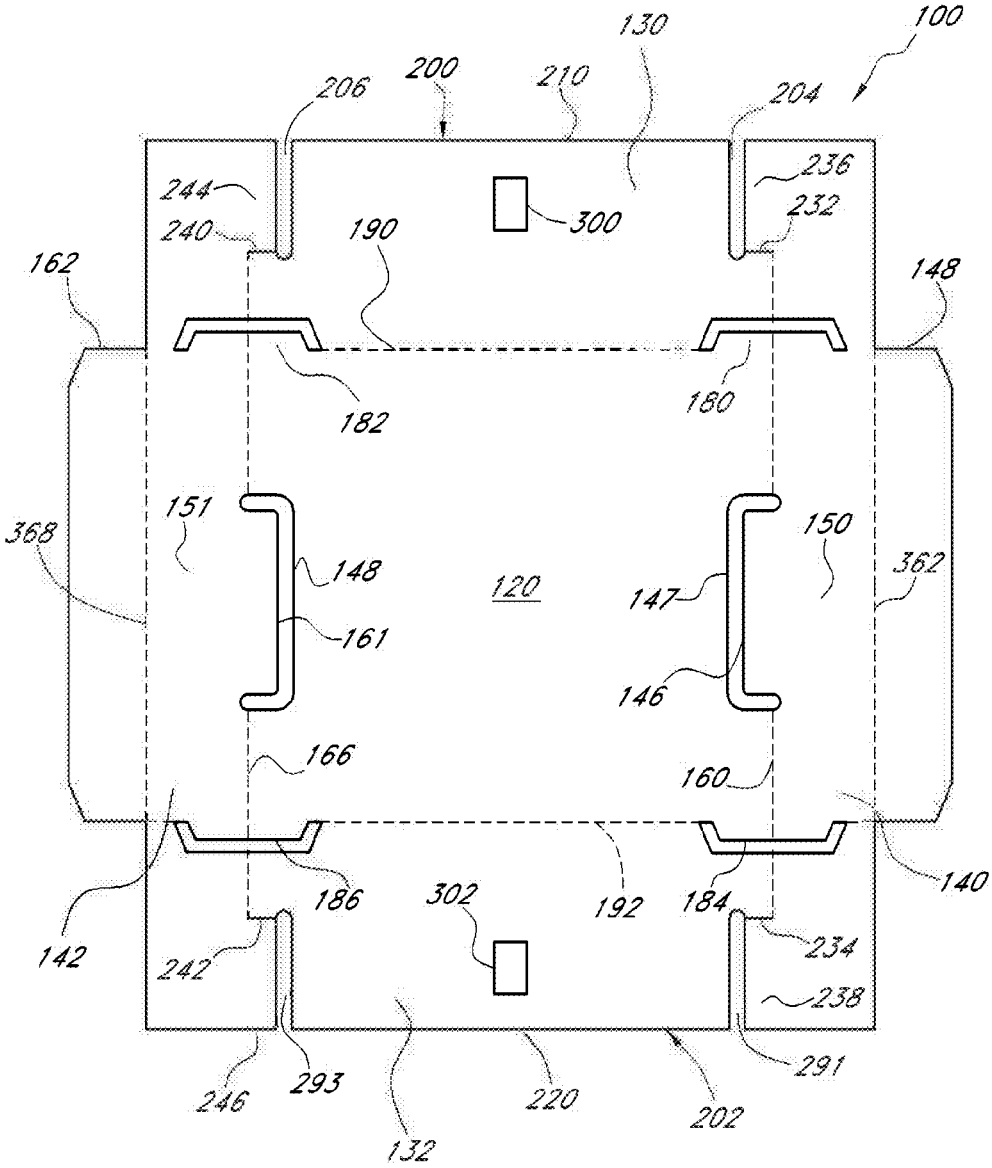
FIG. 1 is a plan view of a packaging member in an unfolded and unassembled state, the packaging member having foldable portions disposed around the periphery of a central base member.
Figure 2:
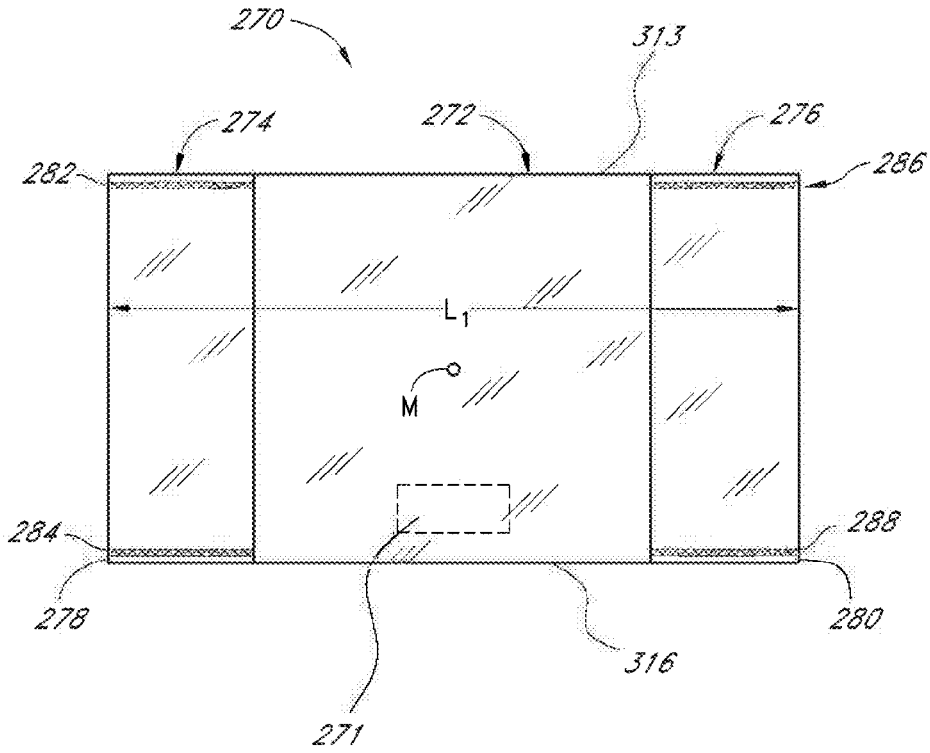
FIG. 2 is a plan view of a retention member having a pair of opposing pockets.

The suspension packaging assemblies disclosed herein can include a packaging member (e.g., packaging member 100, FIG. 1) and a retention member (e.g., retention member 270, FIG. 2), wherein the retention member can include a closure device (e.g., closure device 271, FIG. 2). The suspension packaging assemblies disclosed herein are described in the context of a suspension packaging assembly formed from a packaging member and a retention member having a closure device because they have particular utility in this context. However, the inventions disclosed herein can be used in other contexts as well.

With reference to FIG. 1, a packaging member 100 is illustrated therein in an unfolded state and is constructed in accordance with an embodiment. Generally, the packaging member 100 includes a base member 120 and a pair of opposing foldable portions 130, 132. The base member 120 is configured to engage or provide support for one or more articles to be packaged.

Figure 3:
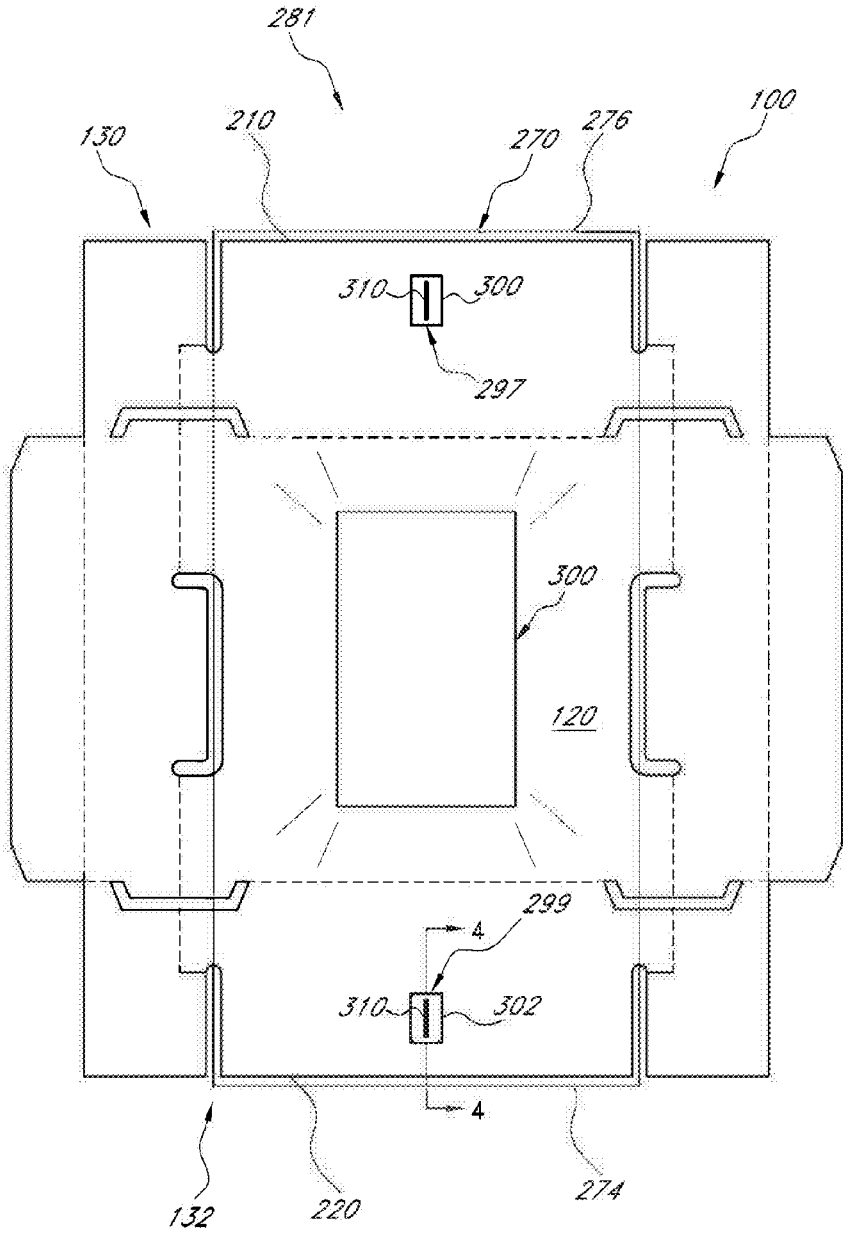
FIG. 3 is a top plan view of a package assembly having the retention member attached to the packaging member, and the package assembly is in an unfolded state with an article disposed between a surface of the retention member and a surface of the packaging member.

In some embodiments, the foldable portions 130, 132 are configured to increase a tension in a retention member (FIG. 2) for holding one or more articles in a desired position relative to the base member, an exemplary position being shown in FIG. 3.

Figure 11:
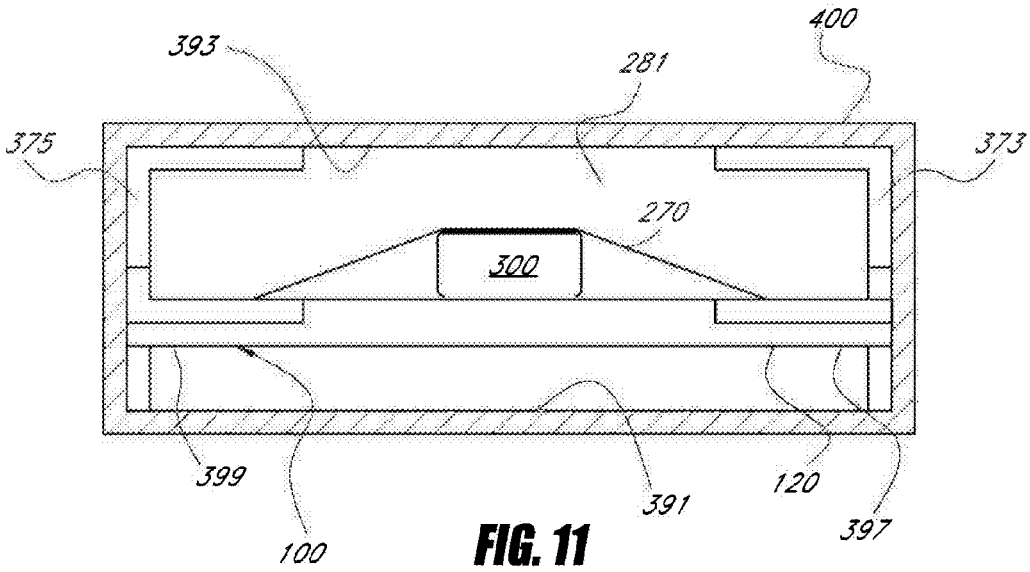
FIG. 11 is a partial cross-sectional view of the package assembly in a fully folded state, and the package assembly is disposed within a container.

In some environments of use, opposing lateral wall portions 140, 142 can be manipulated to form lateral side wall that suspend the base member 120 (see FIG. 11). The lateral wall portions can be configured to extend generally vertically on either side of the base member 120.

With continued reference to FIG. 1, the packaging member 100 can be constructed from various materials, including but without limitation, pulp, paper, cardboard, corrugated cardboard, plastic, combinations thereof, and other appropriate materials. The chosen material for constructing the packaging member 100 can be any substantially rigid but foldable material. It will be appreciated that, although denominated as rigid or substantially rigid, the chosen material would preferably have an amount of flexibility in the cases of extreme physical impact. In some embodiments, the material used to form the packaging member 100 is a single wall corrugated C-flute cardboard. The illustrated packaging member 100 is a generally thin, planar member; however, the packaging member 100 can have other configurations.

The base member 120 can be sized and dimensioned so as to engage or provide support for one or more articles. Although the base member 120 is described primarily as being disposed at the center of the packaging member 100, the base member 120 can be at other locations. Additionally, the base member 120 can comprise a plurality of members, each configured to engage an article. For the sake of convenience, the base member 120 is described as a generally planar centrally disposed member.

The size of the base member 120, which defines a loading area, can be chosen arbitrarily or to accommodate, support, or engage an article of a particular size. The loading area size can be chosen based on the number and configuration of the articles on or proximate to the base member 120. In some non-limiting exemplary embodiments, the base member can be used to package one or more communication devices (e.g., portable phones, cellular phones, radios, headsets, microphones, etc.), electric devices and components, accessories (e.g., cellular phone covers), storage devices (e.g., disk drives), and the like. In certain embodiments, the base member 120 is configured to package one more portable music players, such as IPODs® or MP3 players.

It is contemplated that the base member 120 can be designed to package any number and type of articles. In the illustrated embodiment, the base member 120 is somewhat square shaped and has a surface area (i.e., the loading area) of about 40-60 inches square. In some non-limiting embodiments, the base member has a loading area more than about 40 inches square, 45 inches square, 50 inches square, 55 inches square, 60 inches square, and ranges encompassing such areas. However, these are merely exemplary embodiments, and the base member 120 can have other dimensions for use in communication devices, packaging modems, hard drives, portable phones, or any other article that is to be packaged.

The illustrated base member 120 has a generally flat upper surface that an article can rest against. Other non-limiting base members can have mounting structures, apertures, recesses, partitions, separators, or other suitable structures for inhibiting movement of an article engaging the base member. For example, the base member 120 can have at least one holder that is sized and configured to receive an article.

The lateral wall portions 140, 142 are positioned on either side of the base member 120. The lateral wall portions 140, 142 can be folded upwardly and inwardly to form lateral side walls.

The lateral wall portion 140 can include a lateral wall protrusion 146 and a flap 148. The wall section 150 can be interposed between the protrusion 146 and the flap 148. The lateral wall protrusion 146 can extend laterally and inwardly from the wall section 150. The flap 148 extends laterally and outwardly from the wall section 150. The protrusion 146 and the flap 148 are medially positioned along the packaging member 100.

At least one fold line can be defined between the lateral wall portion 140 and the base member 120. In the illustrated embodiment, a fold line 160 extends between the base member 120 and the lateral wall portion 140. The fold line 160 also extends partially through the foldable portions 130, 132.

The lateral wall portion 142 can include a lateral wall protrusion 161 and a flap 162. A wall section 164 can be interposed between the lateral wall protrusion 161 and the flap 162. The lateral wall portions 140, 142 can be generally similar to each other and, accordingly, the description herein of one of the lateral wall portions applies equally to the other, unless indicated otherwise.

The fold lines can be formed as perforations in the packaging member 100, i.e., broken cut lines passing partially or completely through the material forming the packaging member 100. In the alternative, or in addition, the fold lines can be crushed portions of the material forming the member 100. Of course, depending on the material used to construct the packaging member 100, the fold lines can be formed as mechanical hinges, thinned portions, adhesive tape, or any other appropriate mechanical connection which would allow various portions of the foldable member to be folded or rotated with respect to each other. These concepts apply to all the fold lines described herein, although this description will not be repeated with respect to the other fold lines described below.

The projections 146, 161 are somewhat rectangular in shape. The projection 146, 161 are merely one type of configuration that can be provided for spacing the base member 120 from a support surface, such as an inner surface of a container, when the base member is in a fully folded configuration. An aperture is formed, at least in part, by the protrusion 146. The illustrated aperture 147 is interposed between the protrusion 146 and the base member 120. As such, the protrusion 146 can be moved relative to the base member 120. An aperture 148 is similarly formed between the protrusion 161 and the base member 120.

Optionally, other protrusions can be used to space other portions of the packaging member 100 from surfaces. The illustrated packaging member 100 has protrusions 180, 182. The protrusion 180 is disposed between the foldable portion 130, the base member 120, and the lateral wall portions 140. The protrusion 182 is disposed between the foldable portion 130, the base member 120, and the lateral wall portions 142. Protrusions 184, 186 are formed in a similar manner by the foldable portion 132, the base member 120, and the lateral wall portions 140, 142.

The foldable portion 130 can be folded downwardly about the fold line 190 towards a bottom surface base member 120. When the foldable portion 130 is folded, it can be approximately parallel to the base member 120. In some embodiments, the foldable portion 130 can lie against the base member 120. The foldable portion 132 can be folded in a similar manner about the fold line 192. Thus, the foldable portions 130, 132 can be folded along the fold lines 190, 192, respectively, and pressed against the bottom surface of the base member 120.

The foldable portions 130, 132 can include a mounting portion 200, 202, respectively, that are configured to interact with a retention member such that the retention member and the base member 120 cooperate to securely hold one or more articles. The mounting portion 200 includes a pair of slots 204, 206 that extend at least partially through the foldable portion 130. In some embodiments, including the illustrated embodiment, the slots 204, 206 are elongated slots define lateral edges of an insertable section 210. The mounting portion 202 has a pair of slots 213, 215 that define at least a portion of the insertable portion 220. The insertable sections 210, 220 each can be configured to hold at least a portion of a retention member.

In some embodiments, each insertable section 210, 220 can be configured to fit into a corresponding pocket of a retention member. The insertable sections 210, 220 can securely hold and tension the retention member by folding foldable portions 130, 132 along the fold lines 190, 192, as described in greater detail below. The insertable sections 210, 220 preferably cooperate to tension the retention member so as to resiliently support one or more articles against the base member 120.

Optionally, extreme ends of the fold line 160, identified generally by the reference numerals 232, 234, can be cuts extending completely through the material forming the packaging member 100. As such, tabs 236, 238 can mate with the outer surface of the protrusion 146 when the packaging member 100 is folded. Cuts 240, 242 are defined at the ends of the fold line 166 and define tabs 244, 246, respectively.

FIG. 2 illustrates an exemplary embodiment of a retention member 270, which can have a closure device 271, and which can be mounted to the packaging member 120. Generally, the retention member 270 can be disposed over at least a portion of the packaging member 100. The insertable sections 210, 220 can be disposed in corresponding pockets 274, 276 of the retention member 270. The closure device 271 is described in greater detail below with reference to FIGS. 17-24.

The retention member in the illustrated embodiment is identified as a retention member 270. The retention member 270 preferably is formed of a resilient body 272. For purposes of convenience for the following description, the body 272 is identified as having a mid point M positioned in the vicinity of the middle of the resilient body 272. The resilient body 272 also includes pockets 274, 276 at opposite ends thereof. In the illustrated embodiment, the retention member 270 is formed of a single piece of resilient material, and is sized to cooperate with the foldable portions 130, 132 of the packaging member 100.

In the illustrated embodiment, the pockets 274, 276 are formed of folds 278, 280 formed in the resilient body 272 which have been attached (e.g., heat sealed, bonded, fused, welded, etc.) along lateral opposite edges thereof. In this embodiment, a heat sealing process forms the heat sealing lines 282, 284, 286, 288. The heat sealing lines 282, 284, 286, 288 can be continuous or formed of a plurality of heat sealed points.

One of ordinary skill in the art will appreciate that there are numerous methods for forming pockets in a resilient sheet material such as the resilient body 272. However, it has been found that heat sealing is particularly advantageous as it does not require expensive adhesives and the time consuming steps required for using such adhesives. However, such adhesives can be used if desired. Welding processes (e.g., induction welding), fusing techniques, and the like can also be used to form the lines 282, 284, 286, 288.

The retention member 270 has a length $L_1$ that is sized depending on the other devices with which the retention member 270 is to cooperate. Thus, the length $L_1$ can be sized such that when the retention member is in its final state, e.g., engaged with the foldable portions 130, 132, it generates the desired tension for the corresponding application. Thus, the length $L_1$ will be smaller where a higher tension is desired and will be larger where a lower tension is desired. Additionally, the length $L_1$ might be different for different sized articles that are to be packed. One of ordinary skill in the art can determine the length $L_1$ for the corresponding application.

The retention member 270 can be formed of any resilient material. In some embodiments, the retention member 270 can be made of a polyethylene film. However, virtually any polymer, elastomer, or plastic film can be used to form the retention member 270. The density of the film can be varied to provide the desired retention characteristics such as overall strength, resiliency, and vibrational response. Preferably, the density of the retention member 270 is determined such that the retention member 270 is substantially resilient when used to package a desired article. The retention member 270 can be mono-layer or multi-layer sheet depending on the application.

With reference to FIG. 3, a suspension package assembly 281 includes the packaging member 100 and the retention member 270 connected thereto. An article 300 is securely held between the member 270 and the base member 120 (see FIG. 6). The retention member 270 is preferably permanently mounted to the packaging member 100.

The insertable sections 210, 220 are positioned within corresponding pockets 274, 276. The pockets 274, 276 of the retention member 270 can be placed over the insertable sections 210, 220. The length between the outer edges (i.e., the length of the packaging member 100) of the insertable sections 210, 220 can be slightly greater than the length $L_1$ of the retention member 270. The sealing lines of the retention member 270 can be disposed along the elongated slots 291, 293 of the packaging member 100. The article 300 can be inserted between the member 270 and the base member 120 after the member 270 is mounted to the base member 120.

The assembly 281 can include at least one coupling structure configured to aid in keeping the packaging member 100 connected to the retention member 270. In some embodiments, the packaging member 100 can include one or more coupling structures (e.g., 297, 299) configured to inhibit movement between the retention member 270 and the packaging member 100.

Each of the coupling structures 297, 299 can include at least one mounting aperture for receiving at least a portion of the retention member 270. The mounting portions 200, 202 can also have at least one aperture for forming at least a portion of a coupling assembly. The illustrated mounting portions 200, 202 each have a corresponding aperture 300, 302 that forms at least a portion of a coupling assembly. The mounting apertures are configured to engage a coupler that inhibits relative movement of the retention member 270 with respect to the packaging member 100. The illustrated coupling structures 297, 299 have a single aperture 300, 302, respectively.

Figure 4:
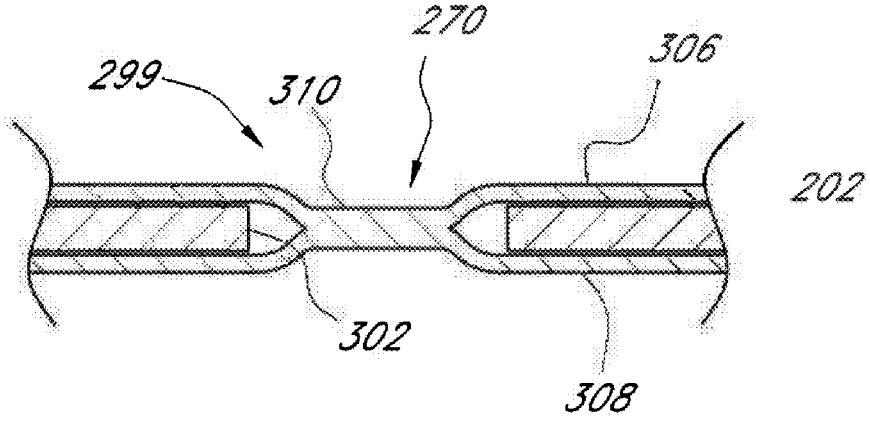
FIG. 4 is a cross-sectional view of an optional feature of the package assembly of FIG. 3 taking along the line 4-4 in FIG. 3.

As shown in FIG. 4, when the pockets 274, 276 are engaged with the mounting portions 200, 202, parts of the pockets are disposed on opposite sides of the mounting portions. In this arrangement, as shown in FIG. 4, the retention member 270 has a first sheet 306 and a second sheet 308 on opposite sides of the corresponding mounting portion.

In other words, a portion of the packaging member 100 that defines the aperture 302, in this case the mounting portion 202, is positioned between the first sheet 306 and the second sheet 308. A coupler 310 of the coupling assembly 299 connects the first sheet 306 and the second sheet 308, and is positioned within the aperture 302. This provides a further advantage in securing the retention member 270 to the packaging member 100. As such, the complete assembly 218 can be shipped to a customer, with the retention member 270 securely connected to the packaging member 100, thereby avoiding the need for the ultimate customer to assemble the packaging member 100 to the retention member 270.

In some embodiments, the coupler 310 can be in the form of a heat seal that can cooperate with the aperture 302 to limit movement of the retention member 270. The heat seal 310 can be formed by a heat sealing process, thermal bonding, fusion, adhesives, and the like. In some embodiments, the heat seals are formed from the material forming the sheets 306, 308.

The heat seal 310 can include one or more heat sealing lines, heat sealed points, or other type of coupling structure. The illustrated heat seal 310 is positioned within the aperture 302. A skilled artisan can select an appropriately sized heat seal 310 to pass through the aperture 302 while maintaining the desired bond between the first sheet 306 and the second sheet 308 during the assembly of the package.

Other configurations can be employed to inhibit movement of the retention member 270 with respect to the packaging member 100. Mechanical fasteners, snaps, closures, or other structures can be used to couple the retention member 270 to the packaging member 100. These can be used alone or in combination with heat seals and/or apertures. For example, the coupling assemblies 297, 299 can be in the form of fasteners that pass through the packaging member 100.

Heat sealing, however, provides yet a further improvement because heat sealing is easily incorporated into manufacturing lines for corrugated cardboard. For example, as raw corrugated cardboard pieces are moved along an assembly line, in which dies are used to cut the raw cardboard into the desired shapes, such a packaging member 100, a retention member, such as a retention member 270, can be placed on the packaging member 100 and heat sealed to it with heat sealing devices. A number of thusly finished assemblies 218 can then be packaged in a box and shipped to the customer with little or no human interaction.

In some embodiments, with reference again to FIG. 4, the apertures 300, 302 can be positioned in the folding portions 130, 132. However, the apertures 300, 302 can be at other locations. Additionally, any number of apertures can be utilized. For example, a plurality of apertures can be positioned at various points along the foldable portions 130, 132. In some embodiments, the foldable portions 130, 132 each have at least two apertures. Each of the apertures preferably interacts with at least one heat seal or other coupling structure.

The apertures 300, 302 can have any suitable shape for receiving a heat seal. The illustrated apertures have are somewhat rectangular. In alternative embodiments, the apertures have are circular, elliptical, polygonal (including rounded polygonal) or other shape as desired.

The retention member 270 remains retained to the packaging member 100 even when the packaging member 100 is manipulated. As such, the retention member 270 can be secured to the packaging member 100 before or after the article is positioned between the retention member 270 and the packaging member 100. Additionally, the retention member 270 remains coupled to the packaging member 100 during, e.g., transportation of the assembled suspension package assembly 281.

Figure 5:
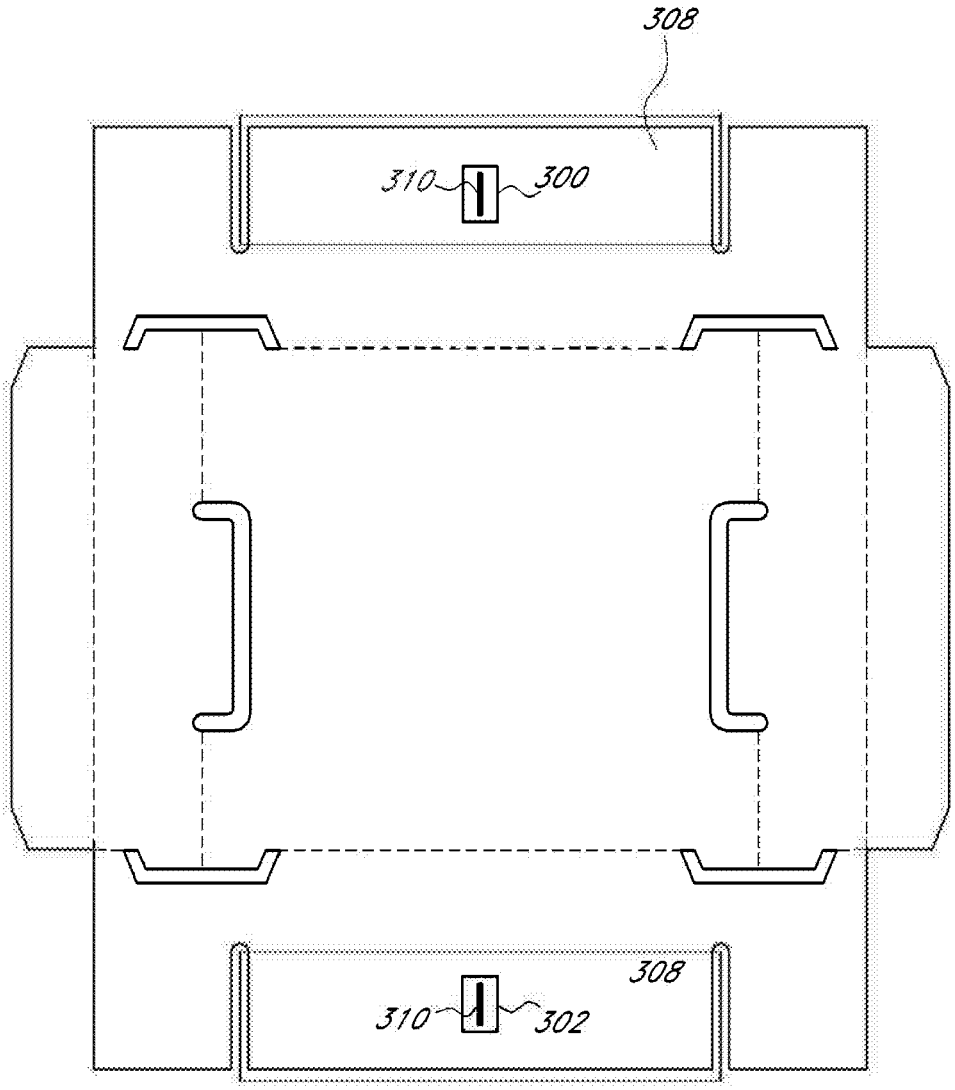
FIG. 5 is a bottom plan view of the package assembly of FIG. 3.
Figure 6:
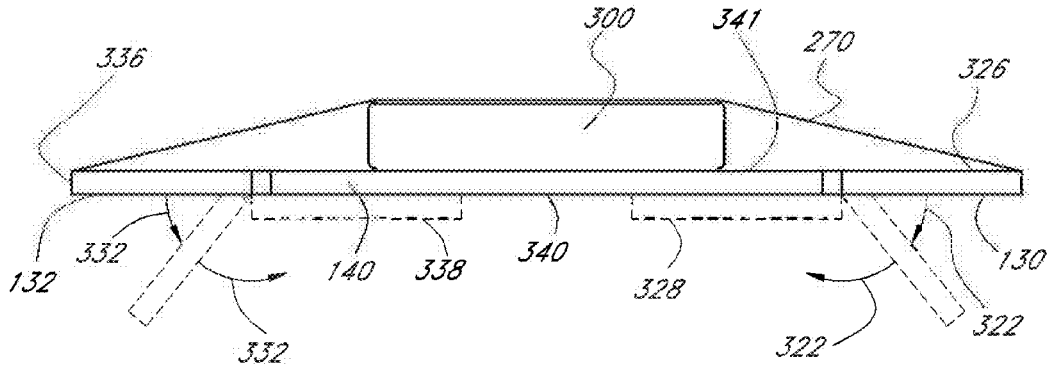
FIG. 6 is a side elevational view of the package assembly and an article held therein.

The package assembly 281 can be folded from the illustrated generally flat configuration of FIGS. 3-5 to tension the retention member 270. FIG. 6 illustrates the foldable portions 130, 132 being folded downwardly along the folding lines 190, 192, respectively, thereby tensioning the retention member 270. The coupling assemblies 297, 299 hold the retention member 270 to the packaging member 100 as the foldable portions 130, 132 are folded.

The foldable portion 130 can be rotated in the directed by the arrows 322 from the unfolded position 326 to the folded position 328. The foldable portion 132 can be rotated in the directed by the arrows 332 from the unfolded position 336 to the folded position 338. The folded positions 328, 338 can be the maximum limit of rotation.

Figure 7:
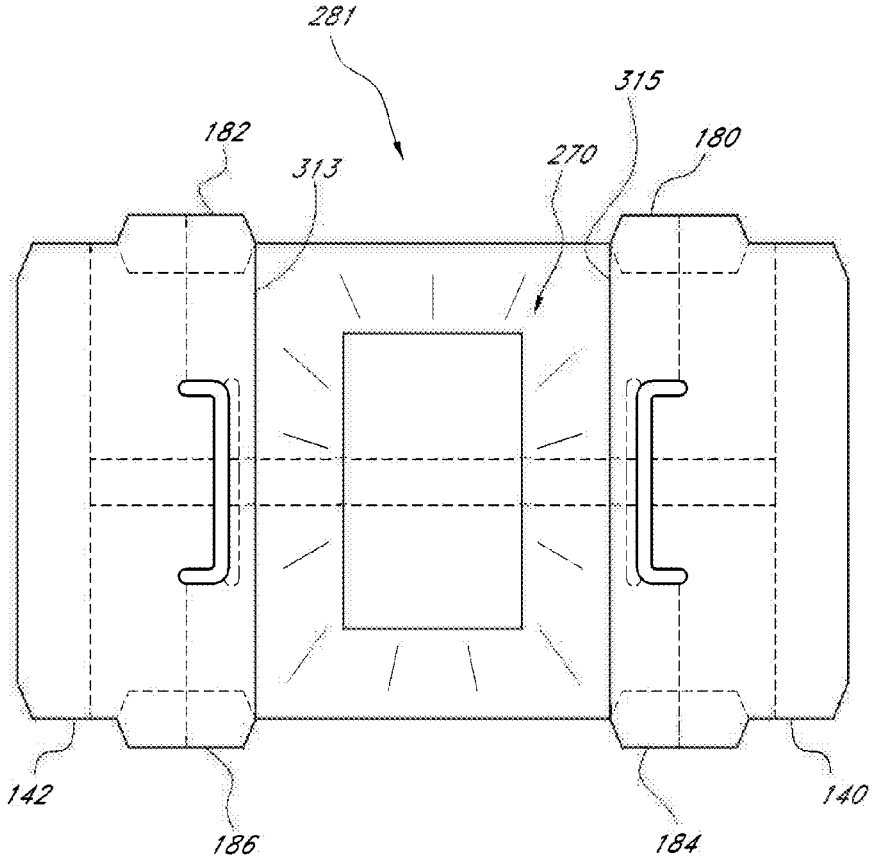
FIG. 7 is a top plan view of the package assembly of FIG. 6 in a partially folded state.

With reference to FIGS. 6 and 7, the foldable portions 130, 132 in the folded position can lie against the bottom surface 340 of the base member 120. In some embodiments, the retention member 270 is stretched when the foldable portions 130, 132 are moved from the unfolded positions 326, 336 to the folded positions 328, 338. The tensioned retention member 270 can tightly hold the article to the upper surface 341 of the base member 120.

The length $L_1$ of the retention member 270 can be decreased or increased to increase or decrease the tensioning of the retention member 270. As shown in FIG. 7, the protrusions 180, 182 can capture the retention member 270 therebetween. The retention member 270 can also be captured between the protrusions 184, 186. The protrusions 180, 182, 184, 186 can cooperate to inhibit lateral movement of the edges 313, 315 of the retention member 270.

Figure 8:
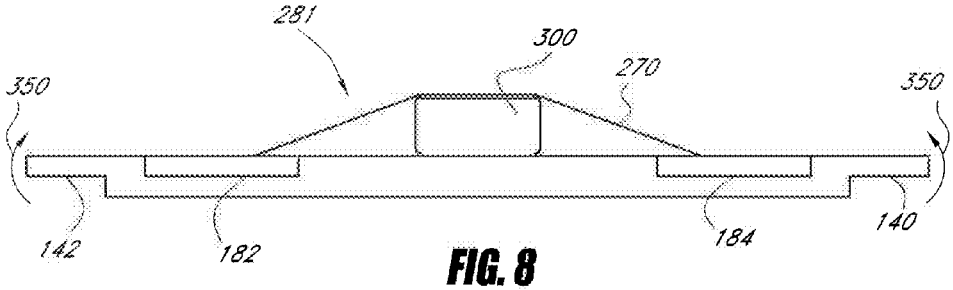
FIG. 8 is a side elevational view of the package assembly of FIG. 6 in a partially folded state.
Figure 9:
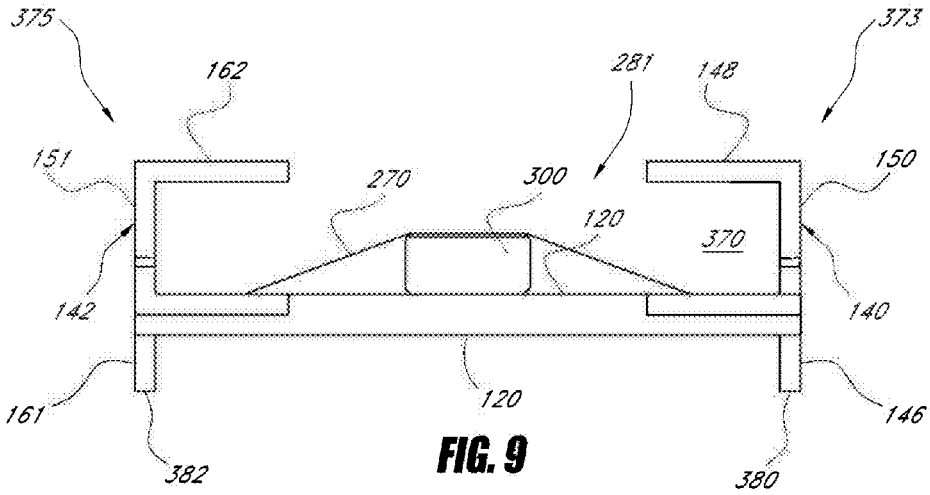
FIG. 9 is a side elevational view of the package assembly of FIG. 6 in a fully folded state.
Figure 10:
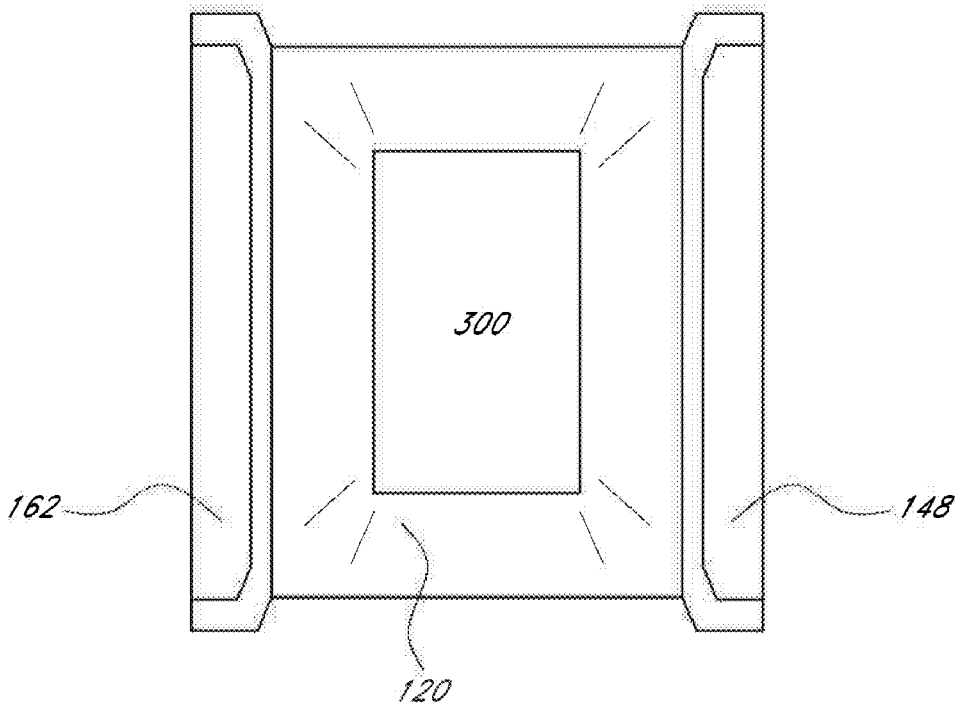
FIG. 10 is a top plan view of the package assembly of FIG. 6 in a fully folded state.

With reference to FIG. 8, in some embodiments, the lateral wall portions 140, 142 can be folded upwardly an inwardly along the fold lines 160, 166 as indicated by the arrows 350. As the lateral wall portions 140, 142 are moved upwardly, the protrusions 146, 161 are moved correspondingly downwardly beneath the base member 120. As shown in FIG. 9, the lateral wall portions 140, 142 can be in a generally upright position. In the illustrated embodiment, the wall sections 150, 151 are generally perpendicular to the base member 120. The lateral wall portions 140, 142 and the corresponding protrusions 146, 161 in the illustrated positions form lateral side walls 373, 375. The lateral walls 373, 375 can be generally perpendicular to the base member 120.

The flaps 148, 162 can be folded inwardly and downwardly along the fold lines 362, 368 (FIG. 1) and can extend inwardly from the upper end of the wall sections 150, 151, respectively. In such an embodiment, the base member 120 and the lateral wall portions 140, 142 cooperate to form a space 370 dimensioned so as to accommodate one or more articles to be packaged. In such an arrangement, the article 300, within the space 370, is protected by the side walls 373, 375 and the base member 120. The article 300 is preferably spaced from the lateral wall portions 140, 142 to further protect the article 300 from external forces. The size and configuration of the space 300 can be chosen by one of ordinary skill to effectively minimize impacts to the article 300 which is retained in the package assembly 281.

The base member 120 extends laterally between the side walls 373, 375. The base member 120 is preferably positioned above the edges 380, 382. The protrusions 146, 161 each have a length that is sized depending on the article 300. If the article 300 causes flexing or bending of the base member 120, the length of each protrusions 146, 161 can be selected to minimize or prevent contact between the bottom surface 340 of the base member 120 and another surface of, e.g., packaging.

For example, the base member 120 can be separated from the bottom 391 of the container 400 as shown in FIG. 11. Thus, the protrusions can be sized such that when the packing assembly 281 is in a container, the base member 120 does not contact the container, even when subjected to vibrations, sudden accelerations, etc. In some non-limiting embodiments, the protrusions 146, 161 have a length of about 0.1 inch, 0.2 inch, 0.25 inch, 0.3 inch, 0.5 inch, 0.75 inch, and ranges encompassing such lengths. In such embodiments, the article can be effectively protected as the base member 120 is adequately spaced from the surface 391 of the container 400. However, protrusions of other lengths and shapes can also be employed.

The base member 120 and the foldable portions 114, 116, which lie against the bottom surface of the base member 120, can cooperate to form a shock absorbing structure beneath the panel 112. That is, the foldable portions 114, 116 reinforce the base member 120.

With reference to FIG. 11, the package assembly 281 can be positioned within a container 400. The container 400 can be configured to transport articles of various configurations. The container can be a shipping container, box, or other suitable packaging container. The container 400 can comprise pulp, paper, cardboard, corrugated cardboard, plastic, combinations thereof, and other appropriate materials.

The article 300 can be suspended from the inner surfaces of the container 400. If the container 400 is rapidly accelerated (e.g., the container 400 and package assembly 281 therein are dropped on the ground), the packaging assembly 281 can protect the article 300. That is, the article 300 can be held securely by the packaging assembly 281 away from the inner surfaces of the container 400, even if there shocks imparted to the container 400 during loading, transit, and/or unloading. The packaging assembly 281 may also advantageously absorb energy (e.g., absorb shocks and/or impacts) to minimize energy transferred to the article 300.

Similarly, the side walls 373, 375 are configured such that the article 300 is separated from the top surface 393 of the container 400. Preferably, the article 300 is suspended securely somewhat midway between the opposing inner surfaces 391, 393 of the container 400. The tensioned retention member 270 inhibits movement of the article 300 relative to the base member 120. The tensioned retention member 270 may advantageously absorb vibrations to further protect the article.

The packaging assembly 281 can have various configurations. The illustrated packaging assembly 281 has a somewhat H-shape as viewed from the side. The end 397 of the base member 120 is connected to the lateral side wall 373. The end 399 of the base member 120 is connected to the lateral side wall 375. The ends 397, 399 are preferably positioned somewhat midway along the lateral side walls 373, 375. That is, the ends 397, 399 of the base member 120 can be spaced from the top and bottom of the lateral walls 373, 375. As such, the lateral side walls 373, 375 can extend vertically on either side of the base member 120.

The container 400 can have any number of packaging assemblies. The illustrated container 400 has a single packaging assembly 281. However, the container 400 can be configured to hold a plurality of packaging assemblies. For example, the container 400 can be sized to accommodate packaging assemblies that are in a vertically stacked arrangement. The packaging assemblies can be in any suitable array for placement in a container.

The packaging assembly 281 can be shipped in the flat and unfolded state as illustrated in FIG. 3. These packaging assemblies 281 can be conveniently stacked. The packaging assemblies 281 can then be densely packed in a tight arrangement allowing a large number of packaging assemblies 281 to be transported and at relatively low cost. Alternatively, the retention members and the packaging members can be stored and transported separately. The retention members and the packaging members can be assembled before being used for packaging articles.

The packaging assemblies 281 can also be stacked in a display structure. Space is a premium commodity in the retail, packaging, and shipping industries. Unused floor or wall space costs the money in lost opportunity. Accordingly, it is important to use as much store space as possible to sell merchandise (either assembled or unassembled packaging assemblies). The densely stacked packaging assemblies 281 can maximum self space and may lead to increased sales. The packaging assemblies 281 can be held in free standing display racks, display cabinets, and various wall and shelving configurations. Various manufacturing processes can be employed to form the packaging assemblies.

Figure 12A:
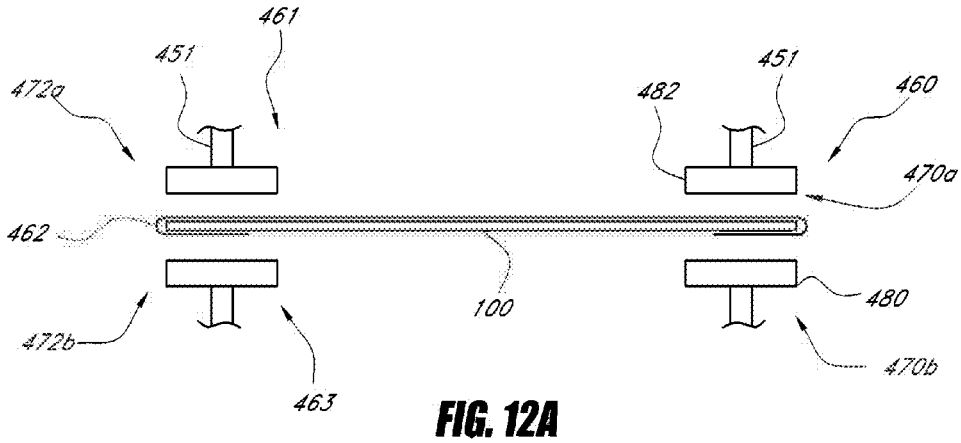
FIG. 12A is a side elevational view of a packaging system in an open position, and the packaging system is configured to form a retention member on a packaging member.

FIG. 12A illustrates a packaging system 460 that is configured to attach a sheet 462 to the packaging member 100. The sheet 462 can be the starting material to form the retention member 270. The packaging system 460 can form one or more heat seals between portions of the sheet 462 on either side of the packaging member 100. In some embodiments, including the illustrated embodiment, the sheet 462 can be positioned around the member 100 such that the packaging system 460 can form the retention member 270 while also coupling the retention member 270 to a packaging member 100. This provides yet another advantage in that the retention member 270 can be formed and attached to the packaging member 100 in a one-step process reducing fabrication time and cost.

With continued reference to FIG. 12A, the packaging system 460 can have an upper movable portion 461 and a lower movable portion 463, each being movable between a closed position and an open position. The upper movable portion 461 has a first section 470A and a second section 472A. The lower movable portion 463 has a first section 470B and a second section 472B. Each of the sections 470A, 470B, 472A, and 472B comprises a sealing element for forming one or more heat seals. The movable sections 470A, 470B include corresponding sealing elements 482, 480 that cooperate to form a heat seal from the sheet 462. Each element can be mounted to an actuator 451. In some embodiments, the sealing elements 480, 482 come together to form the pocket 274 (FIG. 2) of the retention member.

Figure 12B:
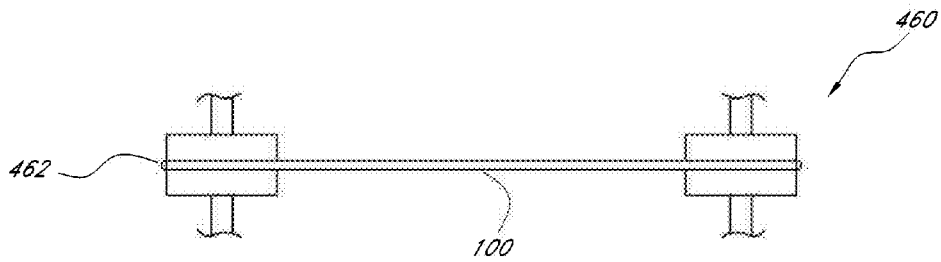
FIG. 12B is a side elevational view of the packing system of FIG. 12A in a closed position.

In the illustrated embodiment of FIG. 12A, the sheet 462 is a sheet that is wrapped around the packaging member 100. The sheet 462 extends across the upper surface of packaging member 100 and along the periphery of the bottom surface of the packaging member 100. To form the sealing lines 288, 286 of FIG. 2, the elements 482, 480 can be brought together. As shown in FIG. 12B, the elements 482, 480 are in a closed position for forming the sealing lines. Optionally, the elements 482, 480 can be used to size and cut the retention member as desired. The elements 482, 480 can have one or more heating elements, welding surfaces, etc.

The heating elements can be at an elevated temperature suitable for forming the sealing lines. The surface of the elements 482, 480 can be heated to a sufficient temperature to cause the portions of the sheet 462 on either side of the packaging member 100 to be sealed together. As such, the retention member 270 can be simultaneously formed and coupled to the packaging member 100. In alternative embodiments, a separate process can be used to cut and trim the retention member to the appropriate size.

Alternatively, the retention member can be pre-formed and then subsequently assembled with the packaging member 100 to form the packaging assembly 281. In other words, the retention member 270 with the pockets 474, 476 can be assembled with the packaging member 100.

Figure 13A:
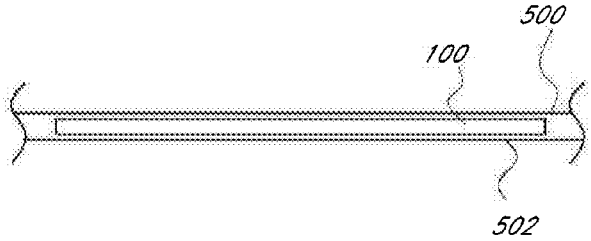
FIGS. 13A-13C are side elevational views of another packaging system for producing a package assembly.
Figure 13B:
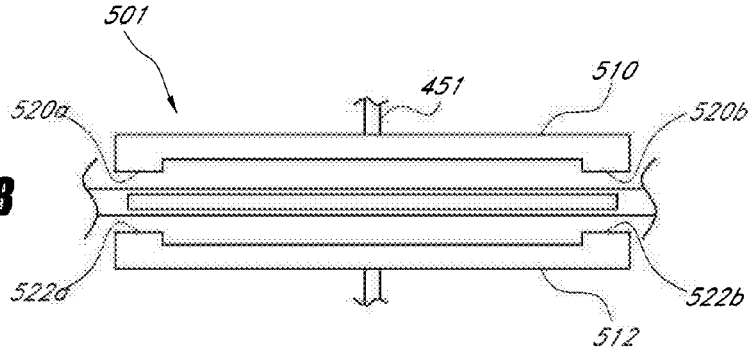
Figure 13C:
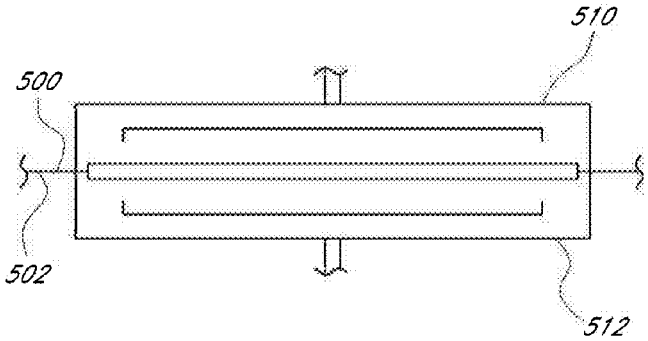

FIGS. 13A-13C illustrate another method of producing the packaging assembly in accordance with the preferred embodiment. Generally, one or more sheets can be used to form a retention member disposed about the packaging member 100. In FIG. 13A, the sheets 500, 502 are separate sheets positioned on either side of the packaging member 100. In some embodiments, the separate sheets 500, 502 are on separate rolls of material and are fed in the same direction as the packaging member 100 is moved during a manufacturing process, for example. In alternative embodiments, a single, unitary sheet can be positioned on both sides of the packaging member 100. That is, a continuous sheet can be folded over the packaging member 100 and used to form the retention member 531 of FIGS. 15A and 15B.

With reference to FIG. 13A, the packaging member 100 is interposed between a pair of sheets 500, 502. The sheets 500, 502 can be delivered by a feed system that can continuously output sheets sized to fit over at least a portion of the packaging member 100. As noted above, the feed system can have a plurality of rollers that spool the sheets 500, 502. The sheets 500, 502 can have a width corresponding to the width of retention member (e.g., the retention member 531 of FIGS. 15A and 15B).

The sheets 500, 502 and packaging member 100 can be positioned within a packing system 501 designed to join at least a portion of the sheet 500 to the sheet 502. As shown in FIG. 13B, the sheets 500, 502 and packaging member 100 are positioned within the packaging system 501 in an open position.

The packaging system 501 includes a first movable portion 510 and a second movable portion 512 each movable between an open position and a closed position. In the illustrated embodiment, the first movable portion 510 and the second movable portion 512 are spaced from the sheets 500, 502. To couple the sheets 500, 502 together, the first movable portion 510 and the second movable portion 512 can be moved to a closed position as illustrated in FIG. 13C.

With continued reference to FIG. 13B, the first movable portion 510 has sealing surfaces 520A, 520B that can be in contact with corresponding sealing surfaces 522A, 522B of the second movable portion 512. The sealing surfaces 520A, 520B, 522A, 522B cooperate to form the retention member. The sealing surfaces 520A, 520B, 522A, 522B can be used to form the heat seals, cut the sheets 500, 502, and/or otherwise form the sheets into a desired configuration.

In some embodiments, when the movable portions 510, 512 occupy a closed position as illustrated in FIG. 13C, the sealing surfaces 520A, 520B, 522A, 522B can be heated and pressed together to seal and couple together the sheets 500, 502. Thus, the packaging system 501 can be used to both attach and form the retention member in a one-step process. The first movable portion 510 and the second movable portion 512 can then be moved away from each other to the open position. The illustrated fabrication process of FIGS. 13A-13C can be used to form a generally continuous retention member that is formed on both sides of the foldable member. Of course, the retention member can be cut from the retention member illustrated in FIGS. 3 and 4.

Figure 14A:
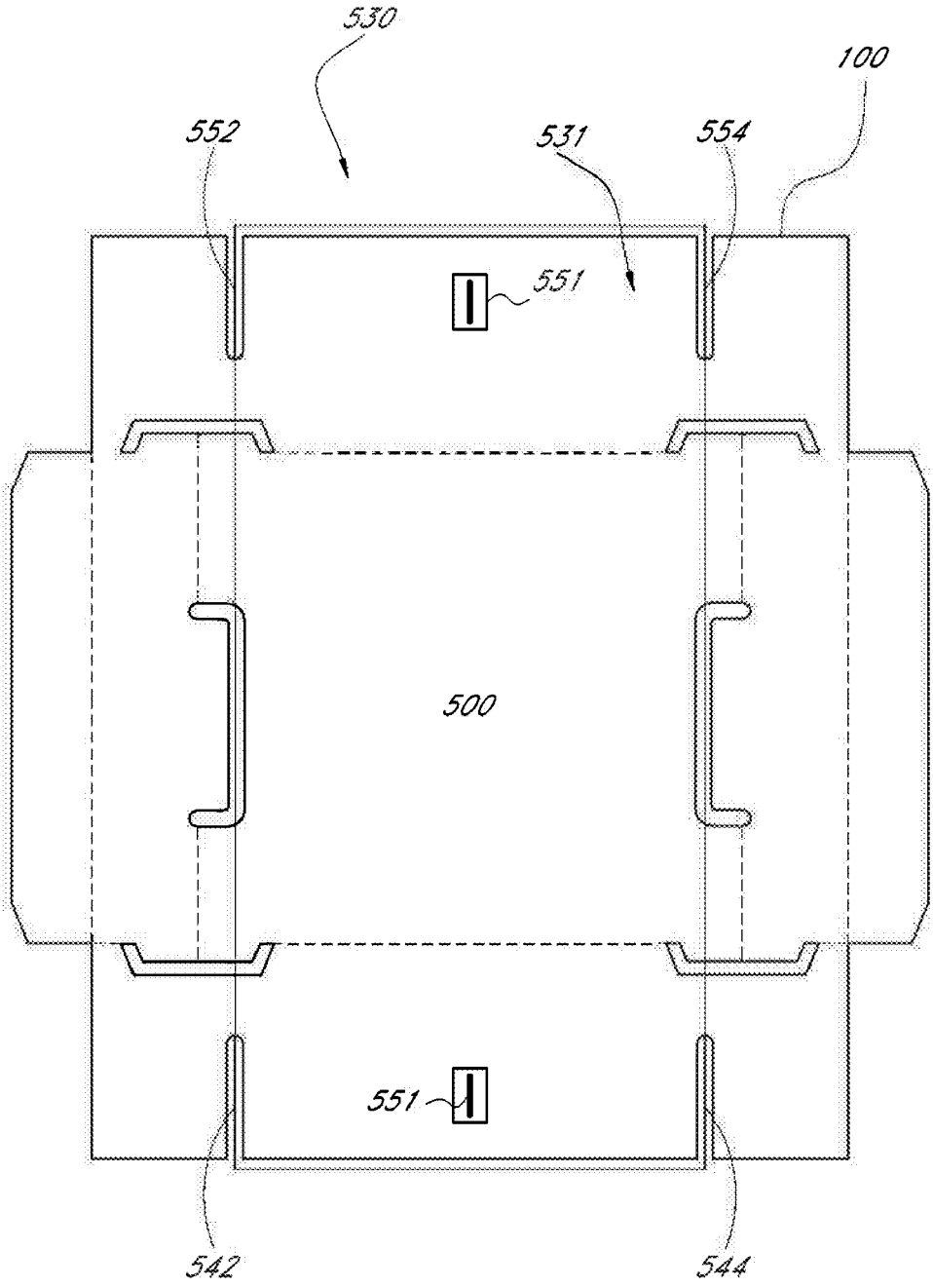
FIG. 14A is a top plan view of a package assembly made by the packaging system of FIGS. 13A-13C.
Figure 14B:
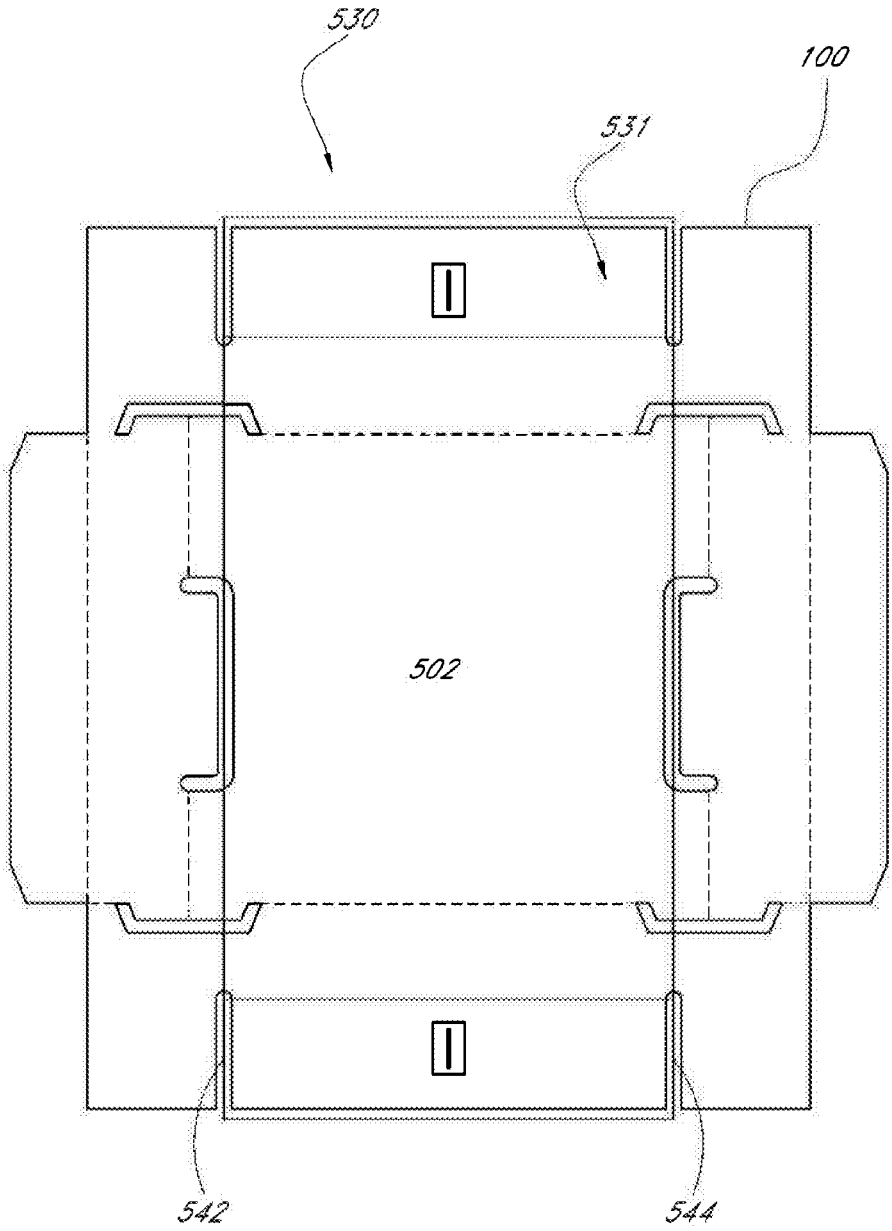
FIG. 14B is a bottom plan view of the package assembly of FIG. 14A.

FIGS. 14A and 14B illustrate a packaging assembly 530 that can produced by the process shown in FIGS. 13A-13C. The retention member 531 extends on both sides of the packaging member 100. In FIG. 14A, the sheet 500 is positioned on one side of the packaging member 100 and the sheet 502 (FIG. 14B) is on the other side of the packaging member 100. The edges 542, 544 of the retention member 531 are formed by the sealing edges 520B, 522B of the movable portions 501, 512, respectively. The edges 552, 554 of the retention member 531 are formed by the sealing edges 520A, 522A of the movable portions 501, 512, respectively.

Optionally, the first movable portion 510 and the second movable portion 512 can simultaneously form the heat seals 551 and the sealing edges 542, 544, 552, 554. Alternatively, the heat seals 551 can be formed subsequently to the forming of the sealing edges. The package assembly 530, for example, can be removed from the portions 510, 512 and the heat seals 551 can be formed in a subsequent process. In some embodiments, the sheets can be coupled to the packaging member 100 so that the sheet remains attached to the packaging member 100 during the folding process. For example, the sheet 602 can be adhered to the lower surface of the packaging member.

Figure 15:
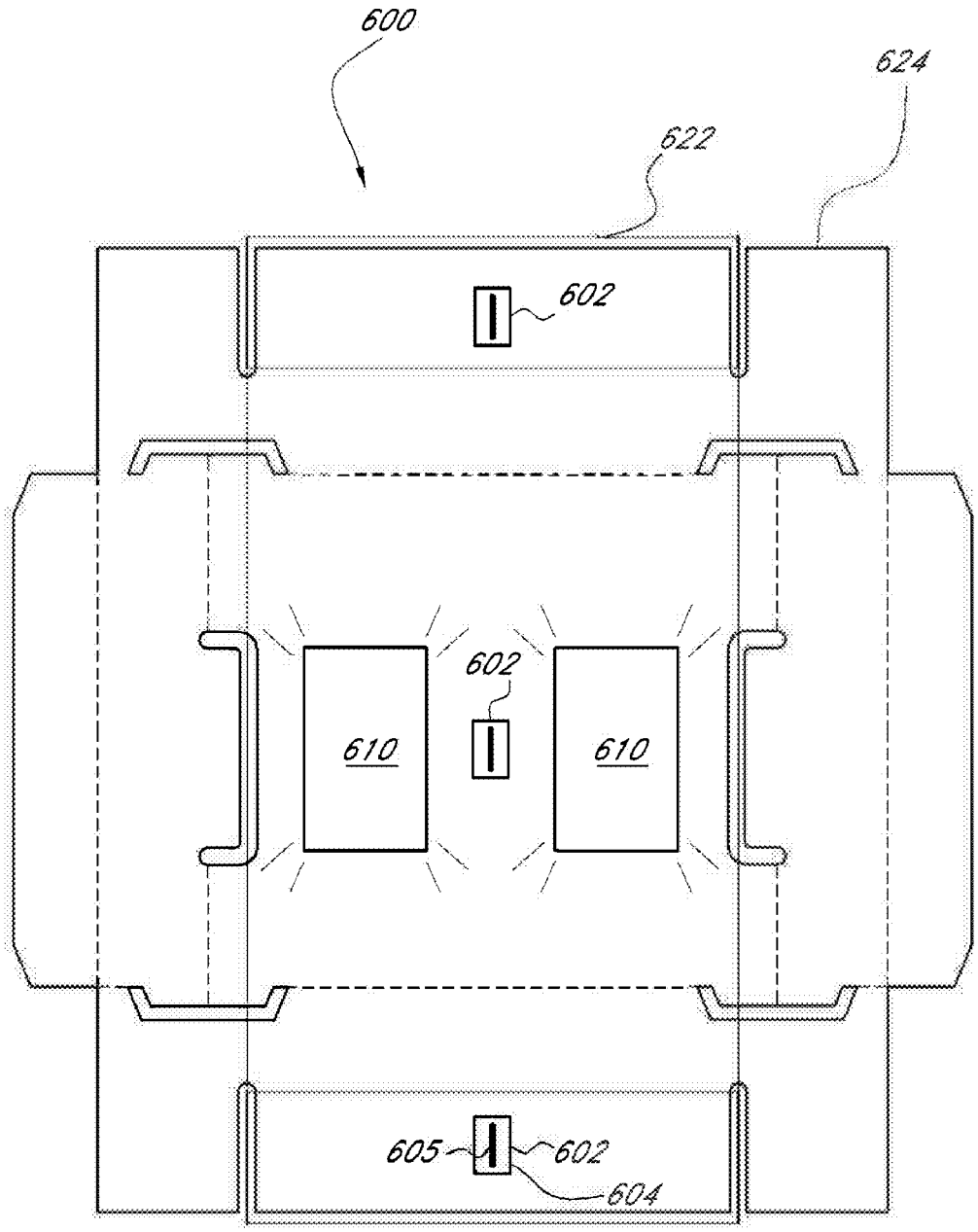
FIG. 15 is a top plan view of a modification of the package assembly of FIGS. 1-15.

FIG. 15 illustrates a modification of the assembly 281, identified generally by the reference numeral 600. The assembly 600 can include a plurality of coupling assemblies 602. The package assembly 600 is generally similar to the package assembly 281, except as described below.

Each coupling assembly 602 can include an aperture 604 and a heat seal 605. At least one of the coupling assemblies 602 can facilitate positioning of the articles 610, even when the packaging assembly 600 is in an unfolded state. The illustrated packaging assembly 600 includes a coupling assembly 602 interposed between the articles 610. In such an embodiment, the coupling assembly 602 tensions the retention member 622 so that the articles 610 are held snuggly against a packaging member 624. The articles 610 can therefore be held securely in place during the folding process.

Figure 16:
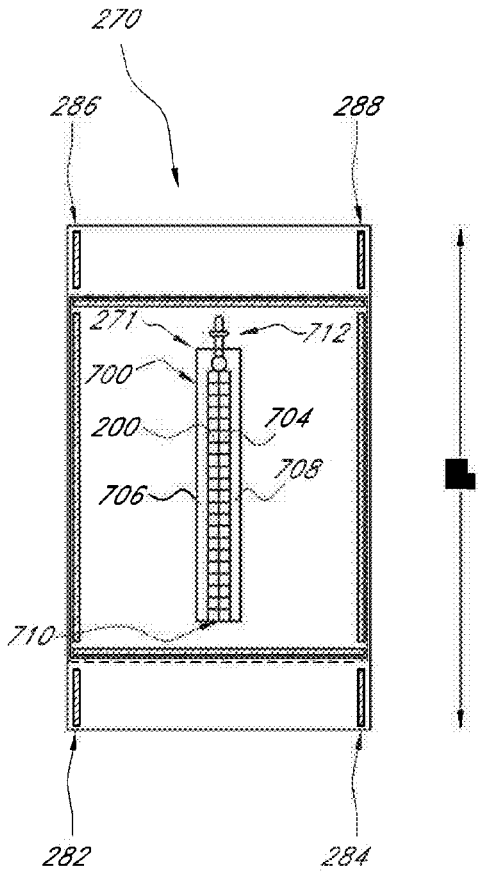
FIG. 16 is a plan view of a modification of the retention member illustrated in FIG. 2, including a closure device.
Figure 17:
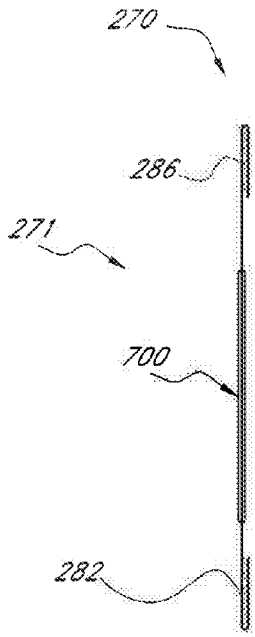
FIG. 17 is a side elevational view of the retention member illustrated in FIG. 17.

With reference to FIGS. 16 and 17, as noted above, the retention member 270 can include a closure device 271. The closure device 271 can be in the form of any type of openable and closeable closure device. For example, but without limitation, the closure device 271 can comprise a zipper, a tongue-in-groove device such as those known as Ziploc® devices, adhesive strips, etc. In the illustrated embodiment, the closure device 271 is in the form of a zipper assembly 700.

The zipper assembly 700 can be formed with any known commercially available zipper components. Such zipper components typically have first and second toothed strips 702, 704. Each of the toothed strips 702, 704 are mounted to a mounting flange 706, 708. The toothed strips can be made from any material, but are typically made from metal or plastic. Additionally, the individual teeth on each of the toothed strips 702, 704 are arranged offset from each other such that they can nest with each other when the toothed strips 702, 704 are engaged with each other.

The zipper assembly 700 can optionally include a connector member 710 disposed at one end of the toothed strips 702, 704. The connector member 710 can be used to permanently attach one end of the toothed strips 702, 704 together. The connector member 710, while it is optional, can also be used to limit movement of the slider member 712 to prevent the slider member 712 from becoming disconnected from the toothed strips 702, 704.

The zipper assembly 700 can also include a slider device 712 that is configured to be slidable along the toothed strips 702, 704 to connect and separate the toothed strips 702, 704 from each other. Such a device is well known in the art and is not described in further detail.

The flanges 706, 708 can be connected to the retention member 270 in any known manner. For example, but without limitation, the flanges 706, 708 can be sewn, glued, heat sealed, or attached to a portion of the retention member 720 in any other manner. Many of the commercially available zipper components include flanges, such as the flanges 706, 708, made from a fabric material. Thus, such flanges 706, 708 can easily be sewn to the material forming the retention member 270.

In the illustrated embodiment, the closure device 271 is illustrated as being disposed in about the center of the retention member 270, with the zipper assembly 700 extending generally along the longitudinal link $L_1$ of the retention member 270. However, any other orientation can also be used. For example, the zipper assembly 700 can extend laterally across the retention member 270, can be oriented along a diagonal line, can be curved, and can be placed offset from the middle of the retention member 270, in one or both of its longitudinal and transverse directions.

With reference to FIG. 3, when the retention member 270 is used in conjunction with a packaging member 100, such as the packaging member 100 illustrated in FIGS. 1 and 3, the closure device 271 can provide further convenience for the user of such a packaging assembly. For example, with reference to FIG. 3, the retention member 270 can be disposed over the foldable portions 130, 132 of the packaging member 100 and the closure device 271 can be opened such that an article 300 can be inserted through the closure device 271 into the proper orientation for packaging. After the article 300 has been inserted through the closure device 271, the closure device 271 can be closed to thereby place the retention member 270 in a state ready for use. Although, in the embodiment illustrated in FIG. 3, the retention member 270 is heat sealed to the packaging member 100, the retention member 270 having the closure device 271 can be used in an embodiment in which the retention member 270 is not heat sealed to the packaging member 100.

Figure 18:
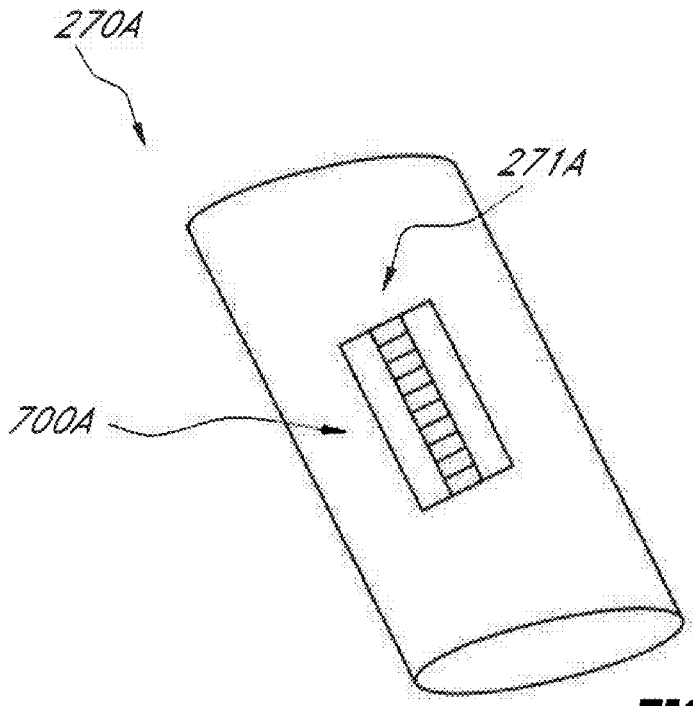
FIG. 18 is a perspective view of a modification of the retention member illustrated in FIG. 16.

FIGS. 18-19 illustrate a modification of the retention member 270, identified generally by the reference numeral 270A. Some of the features, materials, components, and other details of the retention member 270A can be the same or similar to those corresponding components, features, and details of the retention member 270. Thus, portions of the retention member 270A are identified with the same reference numerals used to identify the corresponding components of the retention member 270, except that a "A" has been added thereto.

With reference to FIG. 18, the retention member 270A can be formed from tube material. For example, polyethylene film is commercially available in a tube form, which is schematically illustrated in FIG. 18. Additionally, other materials, such as other polymers, elastomers, and other plastic films, are also available in tube form.

In the illustrated embodiment, the retention member 270A, which in the illustrated embodiment is formed from a polyethylene tube, can also be provided with a closure device 271A constructed in accordance with any of the above embodiments. For example, in some embodiments in which the closure device 271A is a zipper assembly 700A, the tube material forming the retention member 270A can be slit, and then the components of the zipper assembly 700A can be connected to opposite sides of such a slit.

Figure 19A:
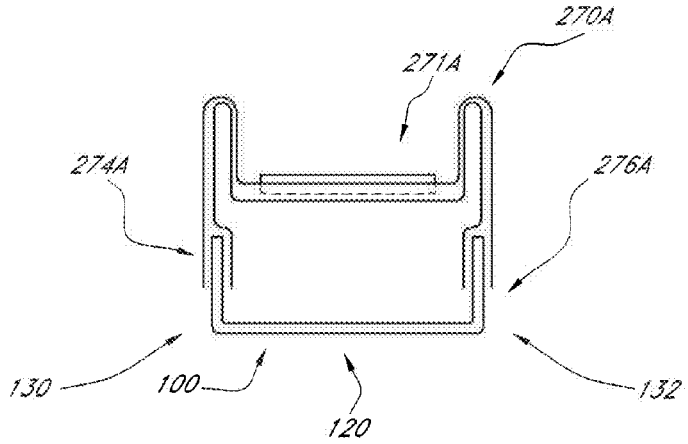
FIG. 19A is a schematic side elevational view of the retention member illustrated in FIG. 18 having pockets engaged with foldable portions of a packaging member.

With reference to FIG. 19A, the retention member 270A can be used to package an article 300. For example, the packaging member 100 is illustrated in FIG. 19A with its foldable portions 130, 132 folded upwardly (as viewed in FIG. 19A) to form a generally 90° angle with the base member 120.

Figure 19B:
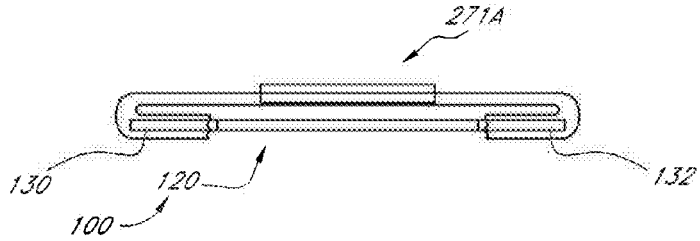
FIG. 19B is a schematic side elevational view illustrating the retention member of FIG. 18 engaged with the packaging member in a second folded state.
Figure 19C:
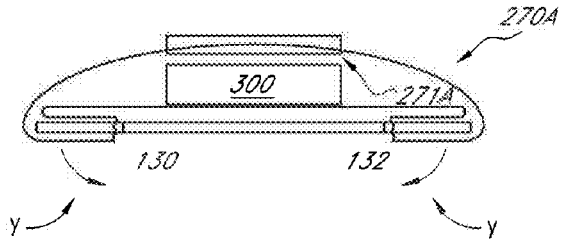
FIG. 19C is a schematic side elevational view of the retention member and packaging member illustrated in FIG. 19B with an article to be packaged disposed within the retention member.

The opposite open ends of the retention member 270A can be considered as forming pockets 274A, 276A, even though they are not closed off from the rest of the interior of the retention member 270A. As such, the pockets 274A, 276A can be fit over the foldable portions 130, 132. After such, the foldable portions 130, 132 can be unfolded toward a flat state, in which the foldable portions 130, 132 are generally coplanar with the base member 120 (FIG. 19B). Optionally, the retention member 270A can be further connected to the packaging member 100. For example, as described above with reference to FIG. 3, the retention member 270A can be further heat sealed to openings 302 that can be formed in the packaging member 100. However, this is optional.

With continued reference to FIG. 19B, in this configuration, the packaging member 100, together with the retention member 270A, can be sent to a customer ready for use. For example, a large number of packaging assemblies including the packaging member 100 and the attached retention member 270A, in the configuration illustrated in FIG. 19B, can be tightly stacked and shipped to a customer, for example, in another larger box. When the customer receives such a packaging assembly, the customer can simply open the closure device 271A, insert an article 300 (FIG. 19C), then close the closure device 271A. Thereafter, the customer can then fold the foldable portions 130, 132 in the direction of arrows Y, which thereby provides additional tension in the retention member 270A, thereby providing further suspension or anchoring force for holding the article 300 against the base member 120.

Figure 19D:
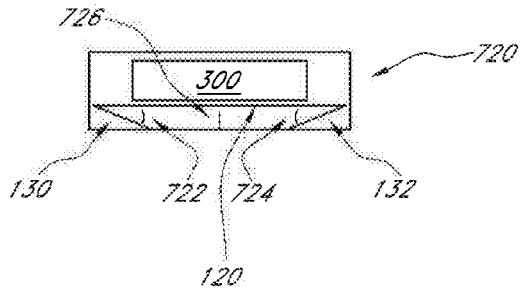
FIG. 19D is a schematic illustration of the assembly of FIG. 19C disposed within a box.

With reference to FIG. 19D, with the foldable portions 130, 132 folded away from the upper surface of the base member 120, the foldable portions 130, 132 can provide an additional spring if the assembled package of the article 300, the retention member 270A, and the packaging member 100 are disposed in an additional box 720. For example, the foldable portions 130, 132, because they are bent to an acute angle beneath the base member 120, can act as cantilever springs. For example, the foldable portions 130, 132, due to their construction (e.g., cardboard) and the tension provided by the retention member 270A (omitted from FIG. 19D) are biased toward an unfolded state, toward the position illustrated in FIGS. 19B and 19C. Thus, as the box 720 encounters shocks, the foldable portions 130, 132 can swing in arcuate directions, identified by the arrows 722, 724, and thereby provide additional shock absorption. Additional members (not shown) can provide a similar limiting or shock absorbing function to maintain the space in-between the packaging member 100 and the top of the box 720. Thus, as the box 720 is subjected to shocks, the base member 120 can move up and down within the box 720 along the arrow 726.

Figure 20:
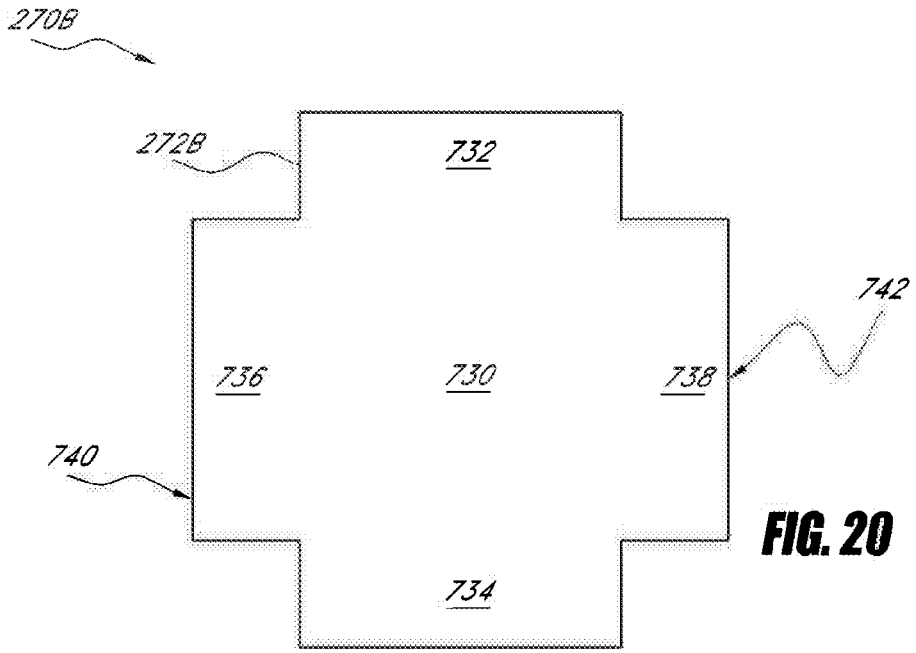
FIG. 20 is a plan view of yet another modification of the retention member of FIG. 2 illustrated in an unassembled state.
Figure 21:
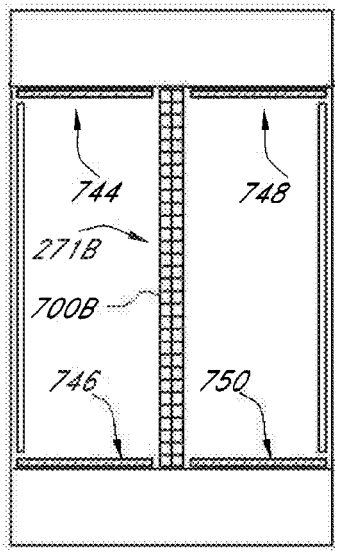
FIG. 21 is another plan view of the retention member illustrated in FIG. 20 illustrated in a partially assembled state.
Figure 22:
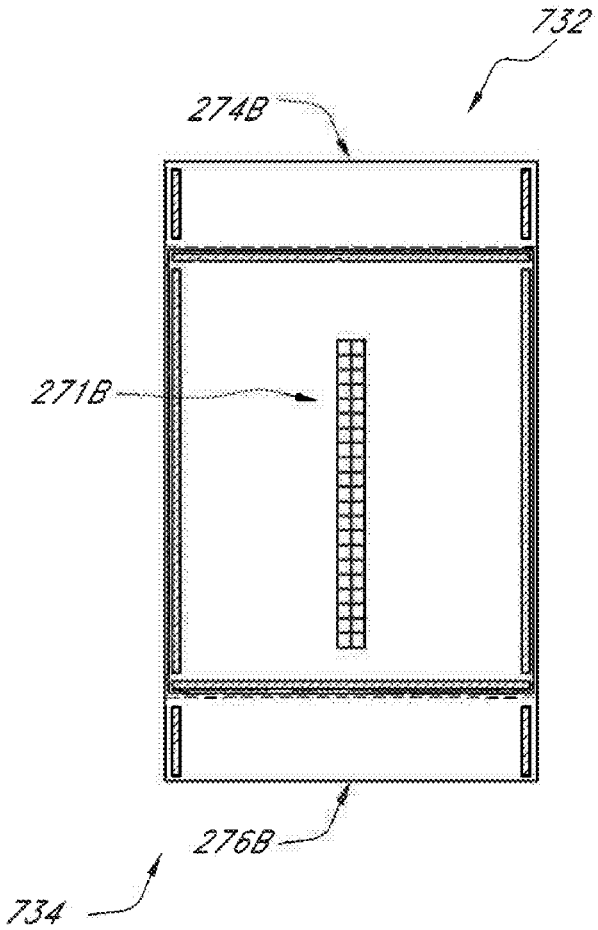
FIG. 22 is a plan view of the retention device illustrated in FIG. 20, in a final assembled state.

FIGS. 20-22 illustrate another modification of the retention member 270, identified generally by the reference numeral 270B. Some of the features, components, and other details of the retention member 270B that can be the same or similar to the corresponding features, components, and details of the retention members 270, 270A, are identified with the same reference numerals, except that a "B" has been added thereto. Thus, the description of some of those features, components, and details are not repeated below.

With reference to FIG. 20, the retention member 270B can form from a single piece of sheet material, referred to as the body 272B.

In the illustrated embodiment, the body 272B defines a central portion 730, longitudinal projections 732, 734, and lateral projections 736, 738. The lateral projection 736 can have an outer edge 740 and the lateral projection 738 can have an outer edge 742.

With reference to FIG. 21, a closure device 271B can be attached to the edges 740, 742 so as to form an enclosure with the central area 730 and the lateral projections 736, 738. In the illustrated embodiment, the closure device 271B is a zipper assembly 700B. Thus, in some embodiments, lateral flanges (not shown) of the zipper assembly 700B can be attached to the edges 740, 742, through any known technique, including those described above.

The other edges of the lateral projections 736, 738 can be heat sealed to the central portion 730. In the illustrated embodiment, such heat sealing forms heat sealed portions 744, 746, 748, 750. As such, the heat sealed portions 744, 746, 748, 750 and the closure device 271B transform the retention member 270B into an enclosure that can be used for packaging an article (e.g., article 300).

Optionally, with reference to FIG. 22, the longitudinal projections 732, 734 can be folded over and heat sealed to form pockets 274B, 276B for use in conjunction with foldable portions of a packaging member, such as the foldable portions 130, 132 of the packaging member 100 illustrated and described above.

Figure 23:
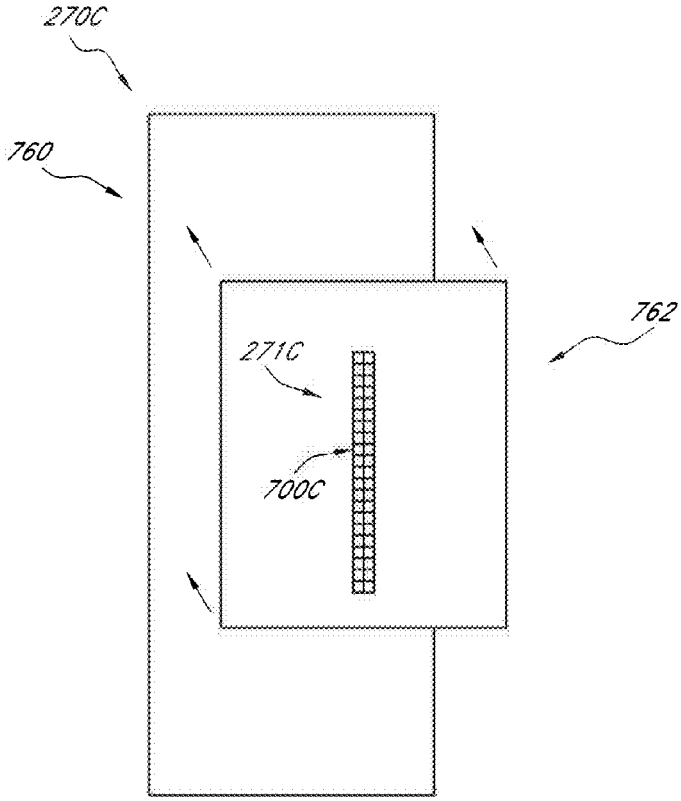
FIG. 23 is an exploded perspective view of a further modification of the retention member illustrated in FIG. 2 having a closure member.
Figure 24:
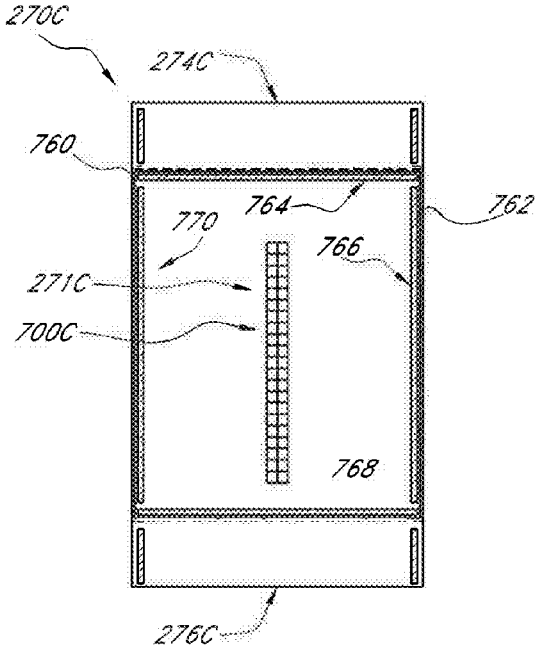
FIG. 24 is a plan view of the retention member illustrated in FIG. 23, in an assembled state.

FIGS. 23 and 24 illustrate yet another modification of the retention member 270, identified generally by the reference numeral 270C. Some of the features, components, and details of the retention member 270C that can be the same or similar to corresponding features, components, and details of the retention members 270, 270A, 270B described above, are identified using the same reference numeral, except that a "C" has been added thereto. Thus, some features, components and details of the retention member 270C are not repeated hereinbelow.

With reference to FIG. 23, the retention member 270C can be formed from first and second portions 760, 762. In some embodiments, the second portion can have a closure device 271C provided thereon. For example, the closure device 271C can be in the form of a zipper assembly 700C.

With reference to FIG. 24, the first portion can be attached to the second portion in any known manner. In the illustrated embodiment, the first portion 760 and the second portion 762 are attached by heat sealing. In the illustrated embodiment, this heat sealing process generates heat sealing portions 764, 766, 768, 770. As such, the first and second member 760, 762 define an enclosed portion in which an article to be packaged (e.g., article 300) can be disposed. For example, the closure device 271C can be opened so that the article 300 can be inserted between the first and second portions 760, 762. After such, the closure device 271C can be closed, thereby enclosing the article 300 between the first and second portions 760, 762.

With continued reference to FIG. 24, the remaining portions of the first portion 760 can be folded to form pockets 274C, 276C. For example, heat sealing can be used again to form the pockets 274C, 276C. As also shown in FIG. 24, the remaining portions of the first portion 760 are folded away from the side to which the second portion 762 is attached. As such, the closure device 271C will be disposed on the side of the retention member 270C that is opposite from the side on which the pockets 274C, 276C are formed.

FIGS. 25-30 illustrate yet another modification of the retention member 270, identified generally by the reference numeral 270D. Some of the features, components, and details of the retention member 270D that can be the same or similar to corresponding features, components, and details of the retention members 270, 270A, 270B, 270C described above, are identified using the same reference numeral, except that a "D" has been added thereto. Thus, some features, components and details of the retention member 270D are not repeated hereinbelow.

FIGS. 25-30 illustrate the steps of a an optional process for manufacturing the modified retention member 270D, with FIG. 30 illustrating the final form of the retention member 270D. The retention member 270D can be manufactured in any process, however, FIGS. 25-30 illustrate one exemplary process.

As shown in FIG. 25, the retention member 270D can start as a single rectangular sheet of a resilient material 800. However, other shapes can also be used. In this modification, the sheet 800 can include lateral edges 802, 804 and longitudinal edges 806 and 808.

With reference to FIG. 26, a closure device 271D can be attached to the lateral edges 802, 804 so that the lateral edges 802, 804 can be attached to one another. In such a configuration, the sheet 800 forms a generally tubular member. The sheet 800 can optionally be pressed flatter (FIG. 27), depending on the heat sealing equipment used, and heat sealed along the remaining free edges of the lateral edges 802, 804, thereby forming heat sealing portions 810, 812.

Following that process, with reference to FIG. 28, the longitudinal ends 806, 808 can be further heat sealed, forming end heat sealed portions 814, 816. Subsequently, the longitudinal ends 806, 808 can be folded over, as shown in FIG. 29. These folded over portions can then be further heat sealed, whereby additional heat sealed portions 818, 820, 822, 824 are formed. In this manner, discrete versions of the pockets 274D, 276D can be formed. Such pockets 274D, 276D, whether they are discrete or not, can be fit over foldable portions of a packaging frame member, such as those described above with reference to FIGS. 1-15. However, other frame members can also be used.

Figure 31:
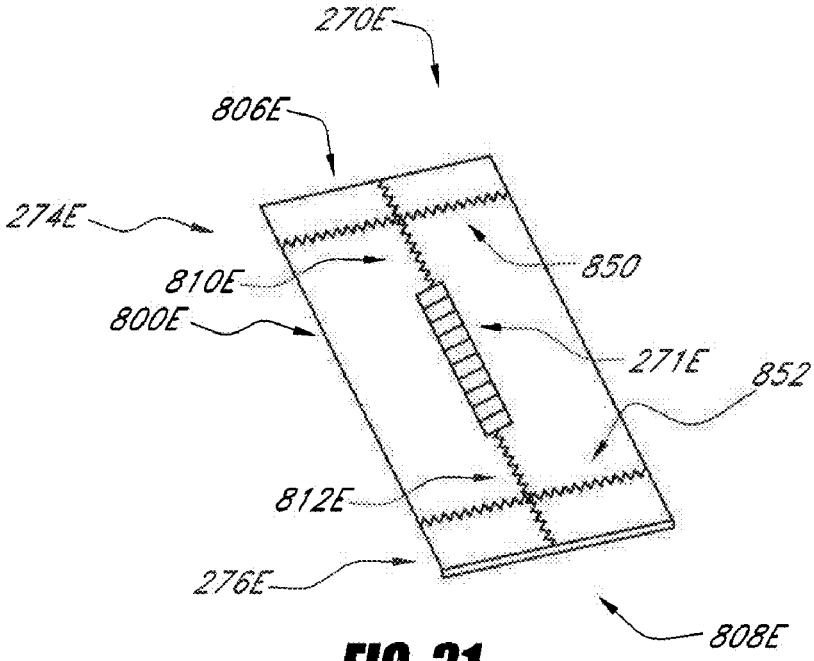
FIG. 31 is a perspective view of the retention member illustrated in FIG. 27 having an optional heat sealing procedure.
Figure 32:
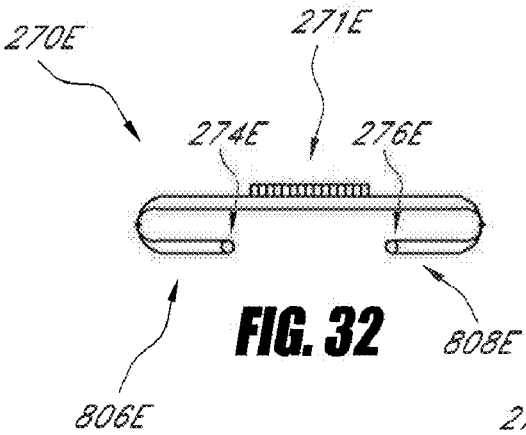
FIG. 32 is a side elevational view of the retention member illustrated in FIG. 31 showing the longitudinal ends thereof folded.
Figure 33:
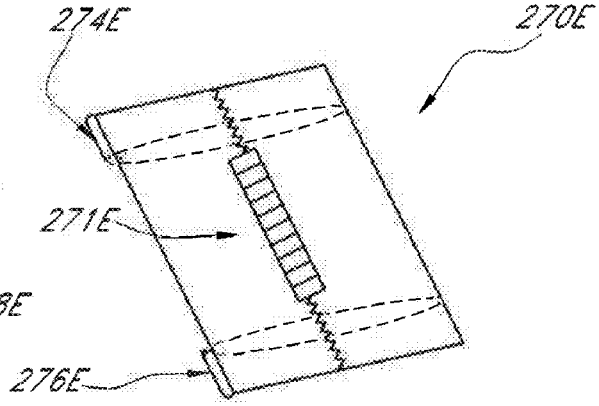
FIG. 33 is a perspective view of the retention member illustrated in FIG. 32.

FIGS. 31-33 illustrate another modification of the retention member 270, identified generally by the reference numeral 270E. Some of the features, components, and details of the retention member 270E that can be the same or similar to corresponding features, components, and details of the retention members 270, 270A, 270B, 270C, 270D described above, are identified using the same reference numeral, except that a "E" has been added thereto. Thus, some features, components, and details of the retention member 270E are not repeated hereinbelow.

The process of making a retention member 270E can begin with the processes noted above with reference to FIGS. 25-27. Thus, for example, after forming the heat sealing portions 810E, 812E, the resilient sheet member 800E can be further heat sealed, laterally, at positions spaced from the longitudinal ends 806E, 808E. For example, as shown in FIG. 31, the resilient sheet member 800E can be heat sealed to form heat sealing portions 850, 852, at positions spaced from the longitudinal ends 806E, 808E, respectively. As such, the free ends of the longitudinal ends 806E, 808E form open pockets, while the interior pocket formed beneath the closure member 271E can be substantially or completely separated from the pockets 274E, 276E by the heat sealing portions 850, 852.

With reference to FIG. 32, the longitudinal ends 806E, 808E can be folded under. The resulting pockets 274E, 276E can receive foldable portions of a packaging member, such as those described above with reference to FIGS. 1-15.

Figure 34:
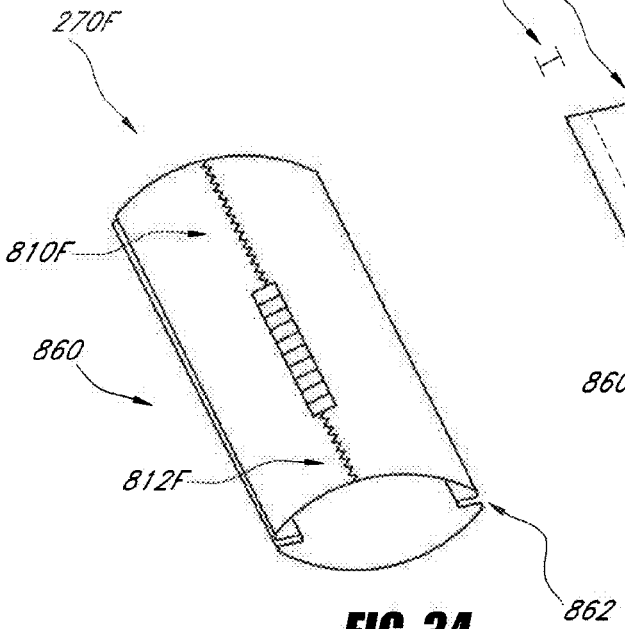
FIG. 34 is a perspective view of yet another modification of the retention member illustrated in FIG. 2 having gusseted lateral edges.
Figure 35:
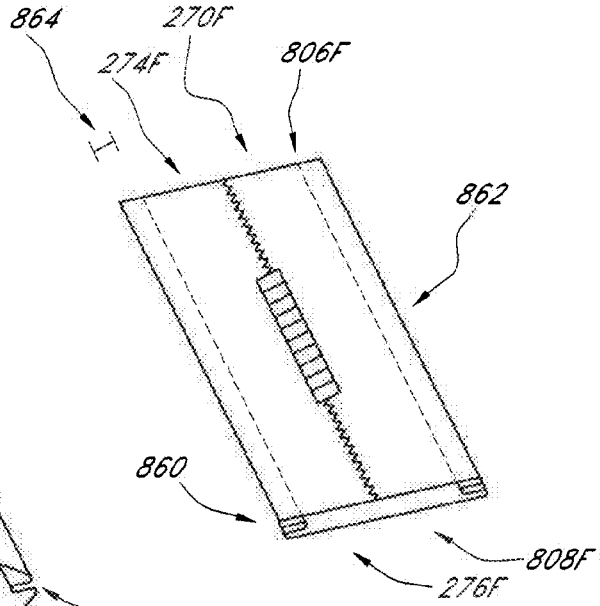
FIG. 35 is a perspective view of the retention member illustrated in FIG. 34 having been pressed into a flatter configuration.

FIGS. 34 and 35 illustrate yet another modification of the retention member 270, identified generally by the reference numeral 270F. Some of the features, components, and details of the retention member 270F that can be the same or similar to corresponding features, components, and details of the retention members 270, 270A, 270B, 270C, 270D, 270E described above, are identified using the same reference numerals, except that a "F" has been added thereto. Thus, some features, components, and details of the retention members 270F are not repeated herein below.

FIGS. 34 and 35 illustrate some of the steps that can be used to form the gusseted retention member 270F, some of the steps being illustrated in other figures. For example, in a process of forming the gusseted retention member 270F, the steps described above with reference to FIGS. 25-27 can first be performed.

With reference to FIG. 34, before or after the heat sealed portions 810F, 812F are formed, lateral sides of the retention member 270F can be folded inwardly to form gussets 860, 862. The size of the gusset can be any dimension. For example, but without limitation, with reference to FIG. 35, the depth 864 of the gussets 860, 862, can be 1", 2", 2½", etc., or any depth. The depth 864 can be adjusted to accommodate the size of the article to be packaged with the retention member 270F.

As shown in FIG. 35, the retention member 270F with the gussets 860, 862 can then be pressed into a flatter configuration. In this flatter configuration, additional heat sealing can be applied to the retention member 270F if desired. However, without any additional heat sealing, the retention member 270F can be used by folding the longitudinal edges 806F, 808F as described above with regard to the retention member 270A and the steps illustrated and described with reference to FIGS. 19-19D.

Optionally, in some embodiments, the retention member 270F can also be further heat sealed to generate discrete pockets 274F, 276F by using any of the techniques or configurations described above, including those described with reference to FIGS. 29, 30, 32, and 33.

Although the present inventions have been described in terms of certain embodiments, other embodiments apparent to those of ordinary skill in the art also are within the scope of these inventions. Thus, various changes and modifications may be made without departing from the spirit and scope of the inventions. For instance, various components may be repositioned as desired. Moreover, not all of the features, aspects and advantages are necessarily required to practice the present inventions.

What is claimed is:

1. A packaging kit for packaging an article and maintaining the article in a position spaced from a wall of a container, the kit comprising:

a resilient member comprising a body portion and first and second pockets disposed at opposite ends of the body portion, and at least one closure device configured to be openable and closeable, the body portion comprising a first layer and a second layer and configured to maintain an article between the first layer and second layers, the at least one closure device being disposed in the first layer, wherein the resilient member comprises a first open end defining a first opening of the first pocket, wherein the resilient member further comprises a second open end opposite the first open end and defining a second opening of the second pocket; and a substantially rigid member comprising:

a base member sized to support the article and comprising a first surface and a second surface opposite to the first surface; and a first foldable portion and a second foldable portion configured to be pivotable relative to the base member, at least an end portion of the first foldable portion configured to be inserted in the first pocket through the first opening and at least an end portion of the second foldable portion configured to be inserted in the second pocket through the second opening, wherein the body portion of the resilient member is disposed over the first surface of the base member, the second layer is disposed between the first layer and the first surface of the base member and the at least one closure device in the first layer is accessible from above the first layer when the first and second foldable portions are inserted in the first and second pockets, wherein the at least one closure device in the first layer is spaced from the second layer by the article when the article is disposed between the first and second layers and the at least one closure device is closed.

2. The kit according to claim 1, additionally comprising a coupling assembly configured to limit relative movement between the resilient member and the rigid member.

3. The kit according to claim 2, wherein the coupling assembly comprises a heat seal.

4. The kit according to claim 1, wherein the closure device comprises a zipper.

5. The kit according to claim 1, wherein the closure device comprises a tongue-in-groove assembly.

6. The kit according to claim 1, wherein the closure device comprises adhesive.

7. The kit according to claim 1, wherein the resilient member defines an enclosed pocket, the closure device being configured to provide an openable and closeable opening into the enclosed pocket.

8. The kit according to claim 1, additionally comprising a box, the substantially rigid member and the resilient member being sized to fit within the box.

9. The kit according to claim 1, additionally comprising a box, wherein the substantially rigid member and the resilient member are configured to support an article to be packaged in a position spaced away from the box and to absorb shocks to prevent the article from making contact with inner surfaces of the box.

10. The kit according to claim 1, wherein the resilient member includes gussets along lateral edges thereof.

11. The kit according to claim 1, wherein the substantially rigid member further comprises a lateral panel rotatable relative to the base member about a fold line between a unfolded state and a folded state, wherein the lateral panel pivotally connected to the base member at the fold line without any intervening portion, wherein the lateral panel comprises top and bottom edges and extends between the top and bottom edges, wherein the fold line is interposed between the top and bottom edges such that the base member is spaced from a top and a bottom of a container in the folded state.

12. The kit according to claim 11, wherein the base member comprises a single flat panel connected to the lateral panel at the fold line without any intervening portion.

13. The kit according to claim 11, wherein the lateral panel comprises a single flat panel connected to the base member at the fold line without any intervening portion.

14. The kit according to claim 11, wherein the substantially rigid member further comprises a flap pivotally connected to the top edge of the lateral panel.

15. The kit according to claim 1, wherein the resilient member comprises a sleeve.

* * * * *